US008245429B2

(12) United States Patent
Kuczynko et al.

(10) Patent No.: US 8,245,429 B2
(45) Date of Patent: Aug. 21, 2012

(54) AUTOMATIC OR SEMIAUTOMATIC RIFLE WITH FOLDING STOCK

(75) Inventors: Grzegorz Kuczynko, Unionville, CT (US); Kevin Langevin, Berlin, CT (US); Paul Hochstrate, Plantsville, CT (US)

(73) Assignee: Colt Defense LLC, Hartford, CT (US)

( * ) Notice: Subject to any disclaimer, the term of this patent is extended or adjusted under 35 U.S.C. 154(b) by 0 days.

(21) Appl. No.: 13/170,159

(22) Filed: Jun. 27, 2011

(65) Prior Publication Data

US 2012/0030983 A1 Feb. 9, 2012

Related U.S. Application Data

(62) Division of application No. 11/869,679, filed on Oct. 9, 2007, now Pat. No. 7,966,761.

(60) Provisional application No. 60/910,804, filed on Apr. 9, 2007, provisional application No. 60/849,947, filed on Oct. 6, 2006.

(51) Int. Cl.
*F41C 23/04* (2006.01)

(52) U.S. Cl. ..... 42/73; 42/75.03

(58) Field of Classification Search ..... 42/71.01, 42/73, 75.01, 75.03
See application file for complete search history.

(56) References Cited

U.S. PATENT DOCUMENTS

| | | | | |
|---|---|---|---|---|
| 2,361,180 | A | 10/1944 | Dobremysl | |
| 2,424,944 | A | 7/1947 | Patchett | |
| 3,380,183 | A | 4/1968 | Miller et al. | |
| 4,383,384 | A | 5/1983 | Fox | |
| 4,735,007 | A | 4/1988 | Gal | |
| 5,272,956 | A | 12/1993 | Hudson | |
| 6,901,691 | B1 | 6/2005 | Little | |
| 7,966,761 | B1 * | 6/2011 | Kuczynko et al. | 42/73 |
| 2005/0267252 | A1 | 12/2005 | Minami | |
| 2008/0028662 | A1 | 2/2008 | Abraham et al. | |

FOREIGN PATENT DOCUMENTS

| | | | |
|---|---|---|---|
| CA | 2597441 | A1 | 7/2006 |
| WO | 2006115703 | A2 | 11/2006 |
| WO | 2008140833 | A2 | 11/2008 |

OTHER PUBLICATIONS

Bushmaster, ACR Owner's Manual, http://www.bushmaster.com/electronic-documents/ACR-owners-manual.pdf, p. 14.

ZM Weapons, LR300 Weapons Manual, LR300 ZM Weapons Manual.pdf.

CZ, CZ 805 Bren A1/A2 Brochure, http://www.czub.cz/zbrojovka/cz-sales-folder/CZ%20805%20ABREN%20ENG.pdf.

Para Ordnance, 2010 Catalog, pp. 18-21, http://www.paraord.com/new/downloads/catalog2010.pdf.

* cited by examiner

*Primary Examiner* — J. Woodrow Eldred
(74) *Attorney, Agent, or Firm* — Cantor Colburn LLP

(57) ABSTRACT

An automatic or semiautomatic rifle having a receiver and a bolt carrier movably coupled to the receiver. An action system is connected to the bolt carrier for cycling the bolt carrier in the receiver. A receiver extension is connected to the receiver, at least part of the action system extending into the receiver extension. A folding stock is connected to the receiver. The receiver extension is located within the folding stock.

16 Claims, 32 Drawing Sheets

AUTOMATIC OR SEMIAUTOMATIC RIFLE WITH FOLDING STOCK

CROSS-REFERENCED TO RELATED APPLICATION

This application is a divisional of U.S. patent application Ser. No. 11/869,679 filed Oct. 9, 2007, which claims the benefit of U.S. Provisional Patent Application Ser. No. 60/849,947 filed Oct. 6, 2006 and U.S. Provisional Patent Application Ser. No. 60/910,804 filed Apr. 9, 2007 the contents each of which are incorporated herein by reference thereto.

BACKGROUND

The disclosed embodiments relate to automatic or semiautomatic rifles and, more particularly, to rifles with a folding stock.

Utility of firearms, especially automatic or semiautomatic rifles for military and law enforcement users, is commensurate with the physical size of the rifle. Moreover, temporarily or transient conditions, such as space around a user or in an access way the user has to traverse, that may exist particularly in the military or law enforcement environments, may result in restrictions on the use of the rifle that may be adequately sized for other more general conditions. Thus, there is a desire for an automatic or semiautomatic rifle that is configurable to enable use in transient space restrictive conditions.

SUMMARY

In accordance with one exemplary embodiment, an automatic or semiautomatic rifle is provided. The rifle has a receiver and a bolt carrier movably coupled to the receiver. An action system is provided connected to the bolt carrier for cycling the bolt carrier in the receiver. A receiver extension is provided connected to the receiver, at least part of the action system extending into the receiver extension. A folding stock is provided connected to the receiver. The receiver extension is located within the folding stock.

In accordance with another exemplary embodiment, an automatic or semiautomatic rifle is provided. The rifle has a receiver and a bolt carrier movably coupled to the receiver. An action system is provided connected to the bolt carrier for cycling the bolt carrier in the receiver. A receiver extension is provided connected to the receiver, at least part of the action system extending into the receiver extension. A folding stock is provided connected to the receiver, the folding stock having a butt stock portion and an extension portion, the butt stock portion rotatable about the extension portion. The receiver extension is located within the folding stock.

In accordance with another exemplary embodiment, an automatic or semiautomatic rifle is provided. The rifle has a receiver and a bolt carrier movably coupled to the receiver. An action system is provided connected to the bolt carrier for cycling the bolt carrier in the receiver. A receiver extension is provided connected to the receiver, at least part of the action system extending into the receiver extension. A folding stock is provided connected to the receiver, the folding stock having a quick release latch engaged with the receiver. The receiver extension is located within the folding stock. Upon disengagement of the quick release latch, the folding stock is removable from the receiver.

In accordance with another exemplary embodiment, an automatic or semiautomatic rifle is provided. The rifle has a receiver and a bolt carrier movably coupled to the receiver. An action system is provided connected to the bolt carrier for cycling the bolt carrier in the receiver. A receiver extension is provided connected to the receiver, at least part of the action system extending into the receiver extension. A folding stock is provided connected to the receiver, the folding stock having a butt stock portion and an extension portion, the butt stock portion rotatable about the extension portion, the folding stock having a quick release latch engaged with the receiver. The receiver extension is located within the folding stock. Upon disengagement of the quick release latch, the folding stock is removable from the receiver.

In accordance with another exemplary embodiment an automatic or semiautomatic rifle is provided. The rifle has a receiver and a bolt carrier movably coupled to the receiver. An action system is provided connected to the bolt carrier for cycling the bolt carrier in the receiver. A receiver extension is provided connected to the receiver, at least part of the action system extending into the receiver extension. A stock is provided connected to the receiver, the stock having a butt stock portion and an extension portion, the butt stock portion rotatable about the extension portion, the stock having a quick release latch engaged with the receiver. The receiver extension is located within the stock. Upon disengagement of the quick release latch, the stock is removable from the receiver.

BRIEF DESCRIPTION OF THE DRAWINGS

The foregoing aspects and other features of the exemplary embodiments are explained in the following description, taken in connection with the accompanying drawings, wherein.

DETAILED DESCRIPTION

Figure 1:
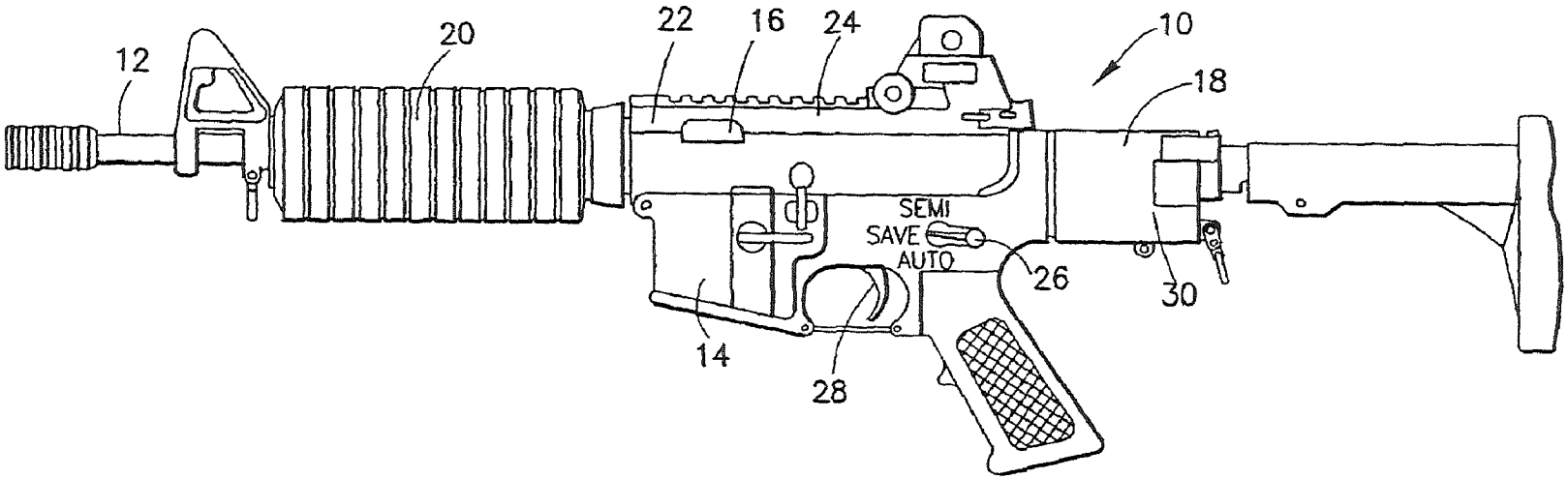
FIG. 1 is a side view of an automatic firearm incorporating features in accordance with an exemplary embodiment.

Referring now to FIG. 1, the firearm 10 may be an automatic or semi-automatic rifle. Firearm 10 is illustrated as generally having a what is generally known as a "black rifle" configuration, the "black rifle" configuration being the family of rifles developed by Eugene Stoner, for example, such as an M4™ (such as available from Colt Defense, LLC) or M16 type automatic firearm configuration. However, the features of the disclosed embodiments, as will be described below, are equally applicable to any desired type of automatic firearm. The rifle 10 generally has a lower receiver 14, an upper receiver, a barrel 12 and stock 18. The upper receiver 16 may be connected to the lower receiver 14 to form a receiver assembly. The barrel 12 is connected to the receiver assembly as is the stock 18. The firearm may have a hand guard 20 over the barrel 12. An example of a suitable hand guard for firearm 10 is described in U.S. Pat. No. 4,663,875, issued May 12, 1987, incorporated by reference herein in its entirety. Other examples of suitable hand guards are described in U.S. patent application Ser. No. 11/113,525 filed on Apr. 25, 2005, incorporated by reference herein in its entirety. The configuration of the firearm 10 in the exemplary embodiment illustrated in FIG. 1 is merely representative, and the features of the exemplary embodiments described below with specific reference to the figures are equally applicable to any suitable firearm with any desired configuration. For example, except as otherwise noted, the firearm may have features, such as the upper receiver, lower receiver, operating mechanism, barrel, hand guard that are generally similar to the M4™ rifle available from Colt Defense LLC. In alternate embodiments, the firearm may have any other desired configuration and features. As noted before, the firearm 10 in the exemplary embodiment may be a rifle capable of automatic or semi-automatic fire. The firearm 10 may have an operating system 22, for example actuated by exhausting barrel gases, that cycles a bolt carrier 24 in the upper receiver to effect automatic or semi-automatic operation of the firearm. The operating system may be direct gas operating system, or in alternate embodiments may be an indirect or gas piston operating system. Suitable examples of gas piston operating systems are described respectively in U.S. patent application Ser. No. 11/231,063 filed on Sep. 19, 2005, U.S. patent application Ser. No. 11/352,036 filed Feb. 9, 2006 and U.S. Provisional Patent Application No. 60/772,494 filed Feb. 9, 2006, all incorporated by reference herein in their entireties. The firearm 10 may have a selector mechanism 26 (see FIG. 1), that interfaces with the firearm trigger system 28 to allow operator selection between, for example "AUTO" (automatic) "SEMI" (semiautomatic) and "SAFE" (safety) operating modes. Cycling of the bolt carrier 24 is effected by the operating system (as noted before) in cooperation with a bolt carrier return system 30 described in greater detail below. The bolt carrier return system 30 may be located in the stock 18 of firearm 10. In the exemplary embodiment shown in FIG. 1, the stock 18 is a folding stock as will also be described in greater detail below. The stock 18 may also have a telescoping or extendable portion providing stock with selectably variable length.

Figure 2:
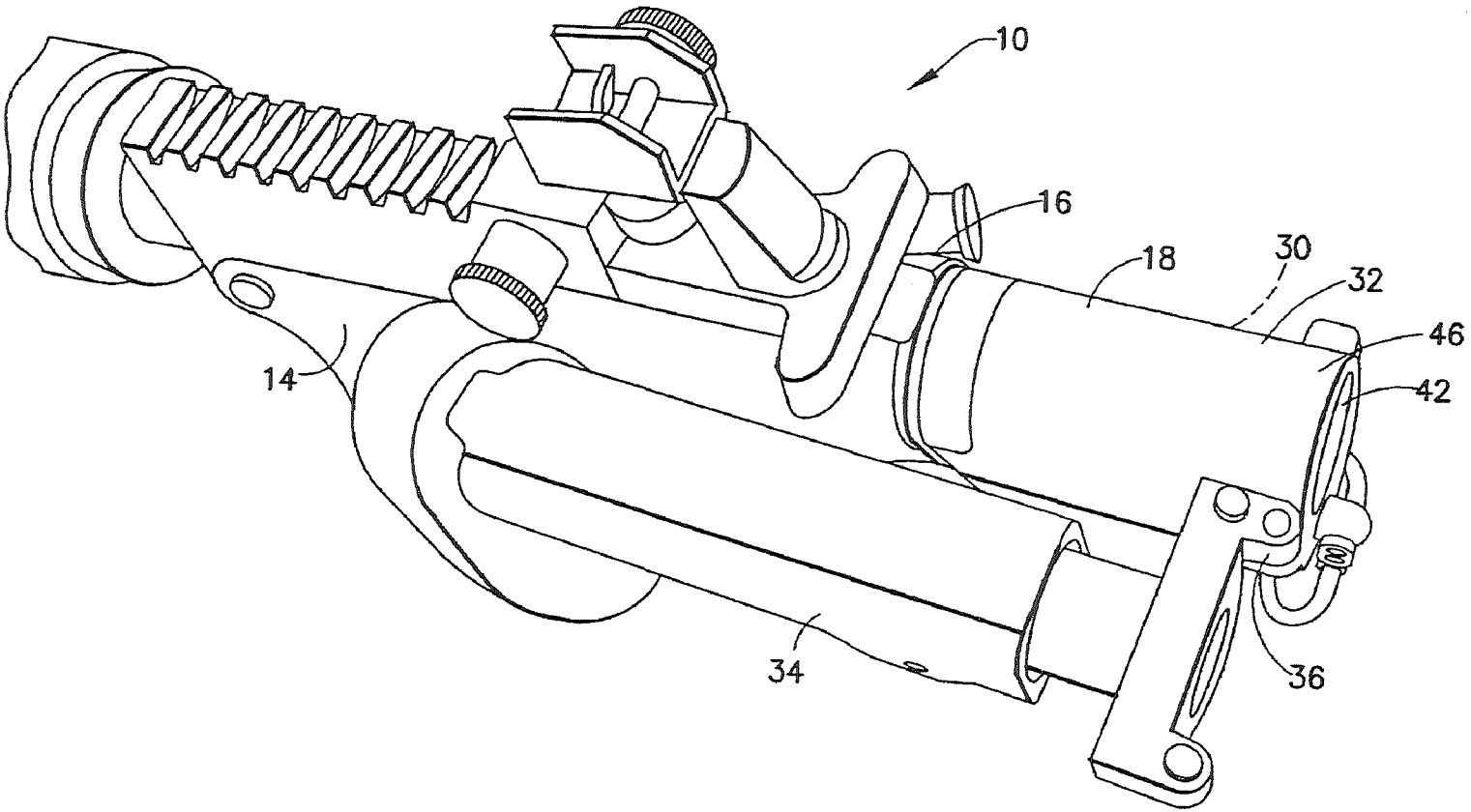
FIG. 2 is a isometric view of an automatic firearm with a folding stock shown in a first position.
Figure 2A:
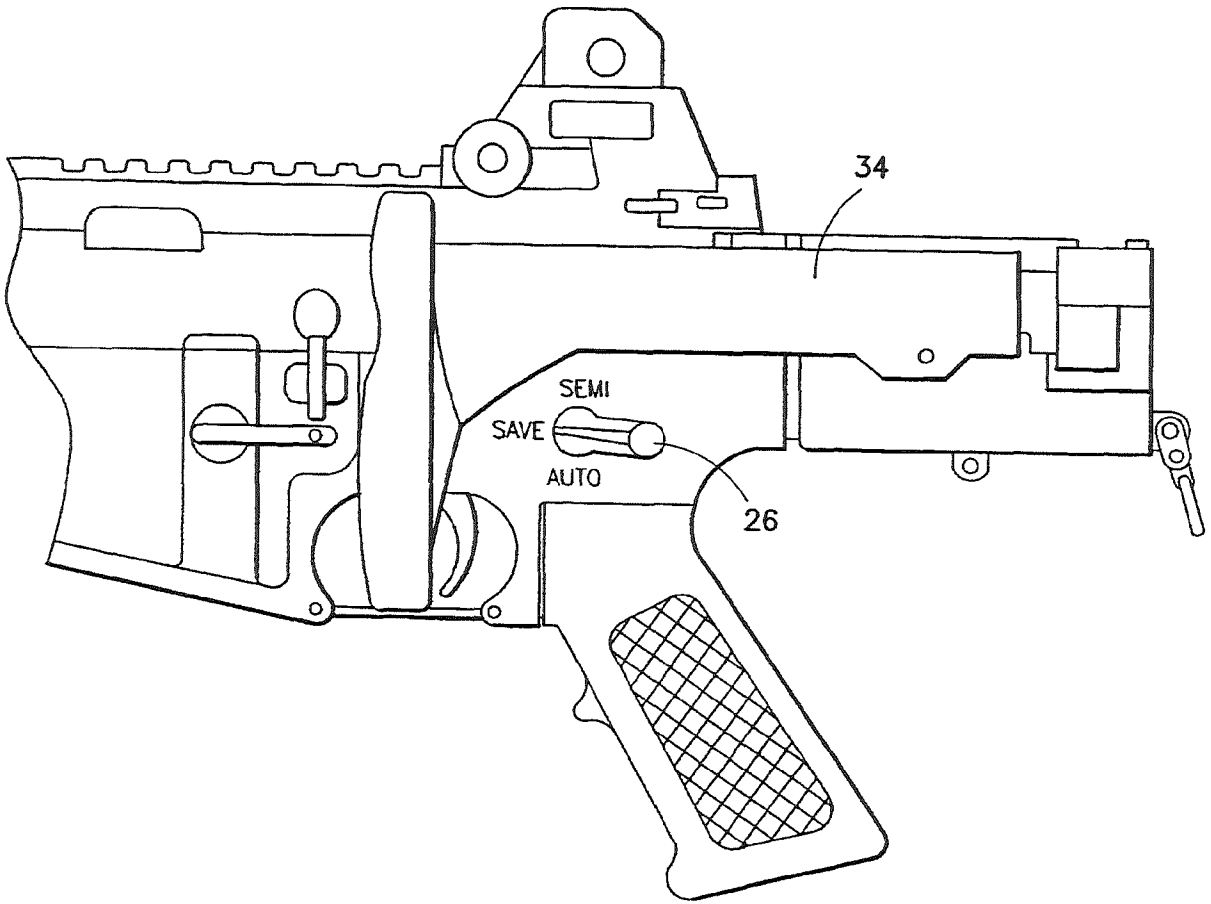
FIG. 2A is a side view of an automatic firearm with a folding stock shown in a first position.
Figure 2B:
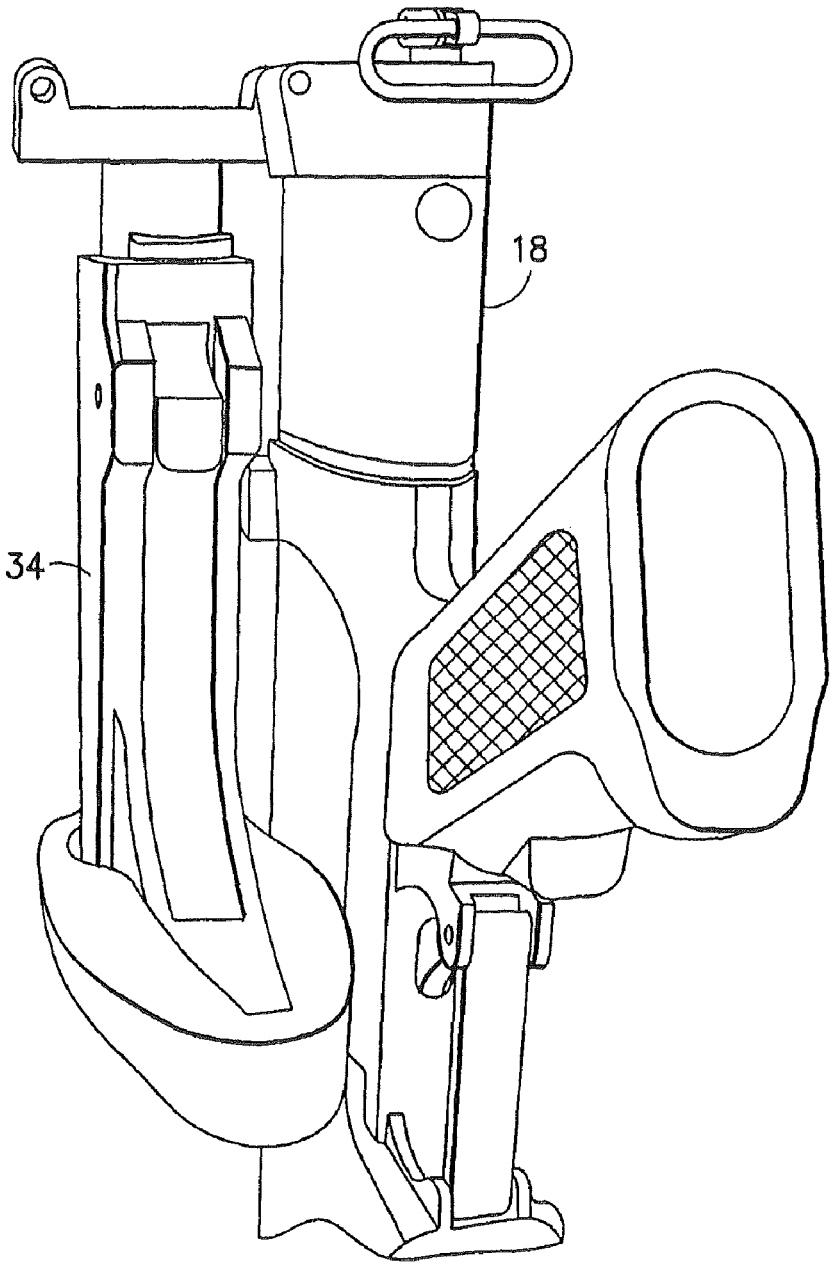
FIG. 2B is a isometric view of an automatic firearm with a folding stock.
Figure 2C:
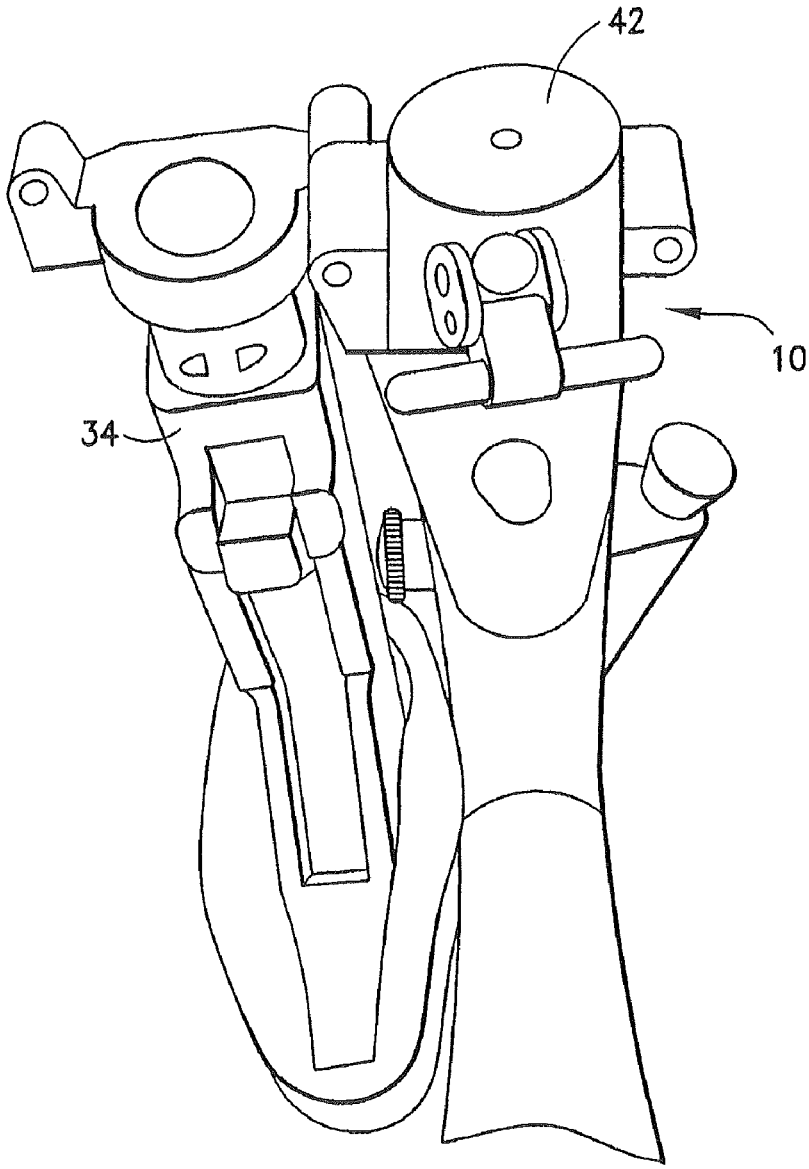
FIG. 2C is a isometric view of an automatic firearm with a folding stock.
Figure 2D:
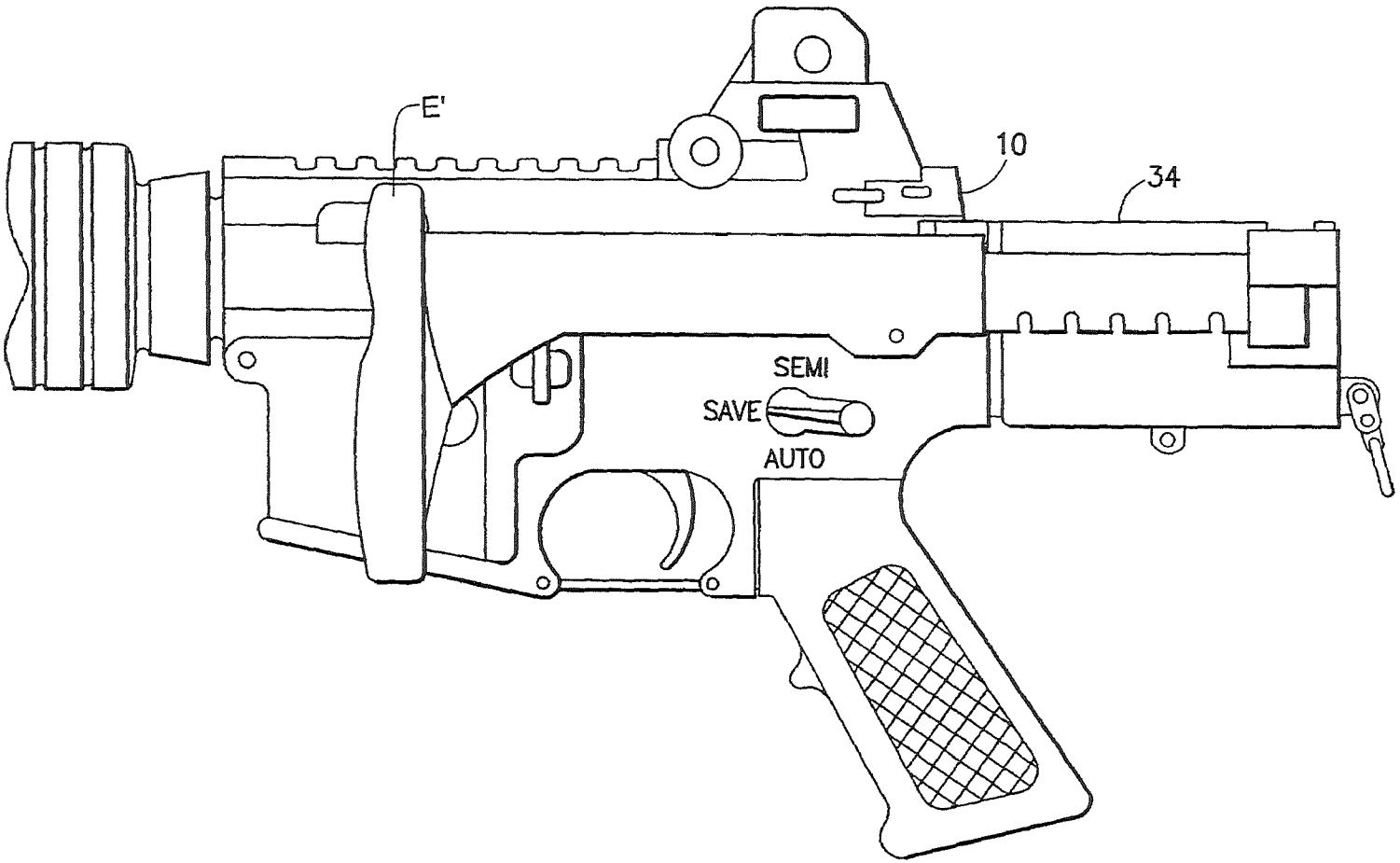
FIG. 2D is a side view of an automatic firearm with a folding stock shown in another position.

Referring now also to FIGS. 2-2D there is respectively shown a top plan view; a left elevation view, a bottom view, a rear perspective view and another left elevation view of firearm 10. In FIGS. 2-2C, the firearm 10 in the exemplary embodiment is illustrated with the stock 18 in a folded condition. In FIG. 2D, the firearm is illustrated with the folded stock extended to a representative extended position E1. As seen best in FIG. 2, in the exemplary embodiment, the stock 18 may have what may be generally referred to as a base portion 32 and folding portion 34. The base portion 30 or the stock 18, mates the stock to the lower receiver 14. The folding portion 34 is joined to the base portion 34 by a coupling 36 that allows the folding portion 34 to be folded, or rotated relative to the base portion 18 from a deployed position (or unfolded position as illustrated in FIG. 1 for example) to a folded or stowed position(s) (shown for example in FIGS. 2-2D) as will be described further below. In the exemplary embodiment illustrated in the figures, the folding portion is shown for example folded on the left side of the firearm. In alternate embodiments, the folding portion of the stock may have more than one folded position. For example the folded portion of the stock may be folded down or on the right side of the firearm. In other alternate embodiments, the folding portion may be moved to any other desired folded position.

Figure 3:
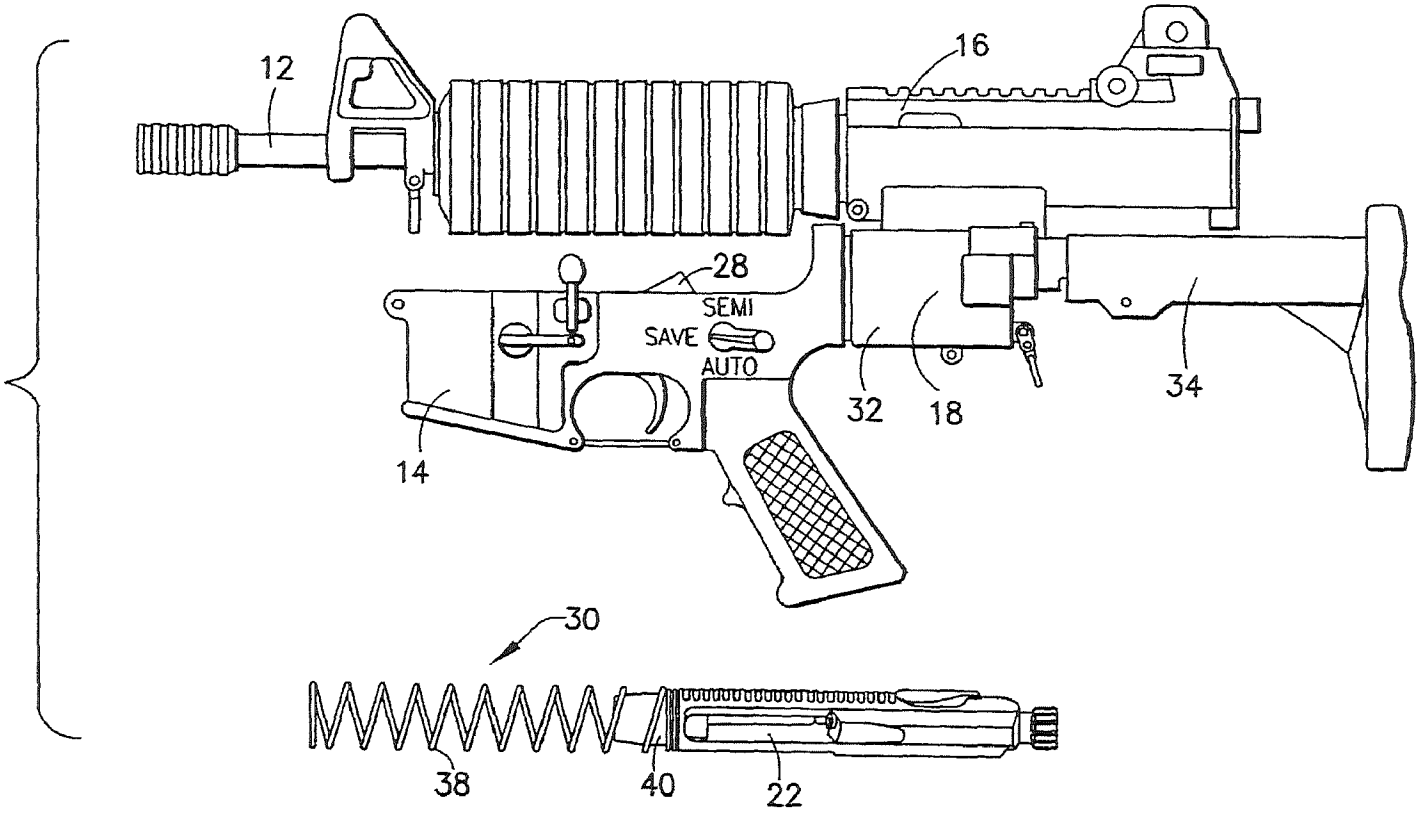
FIG. 3 is an exploded view of an automatic firearm with a folding stock.
Figure 4:
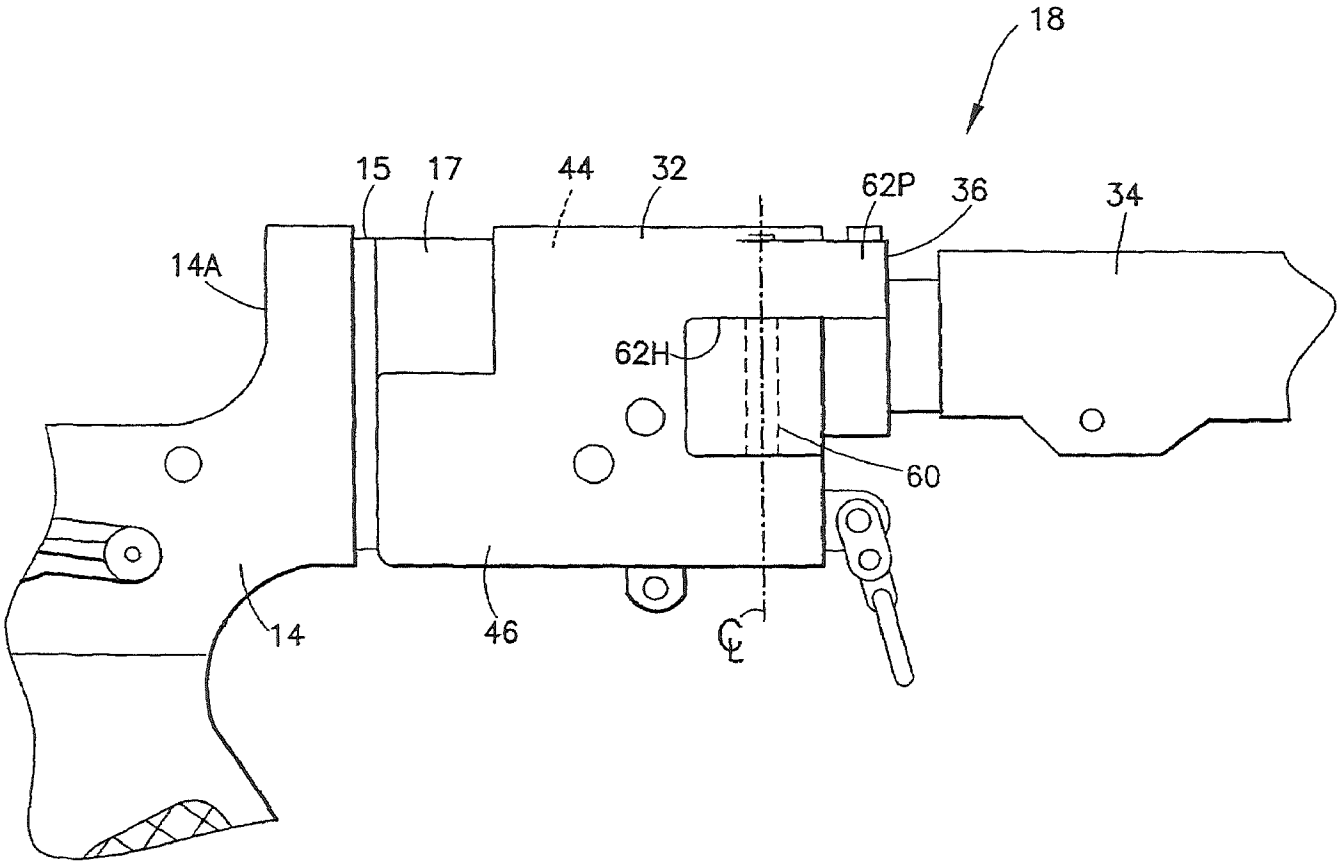
FIG. 4 is a partial side view of an automatic firearm with a folding stock shown in yet another position.
Figure 4A:
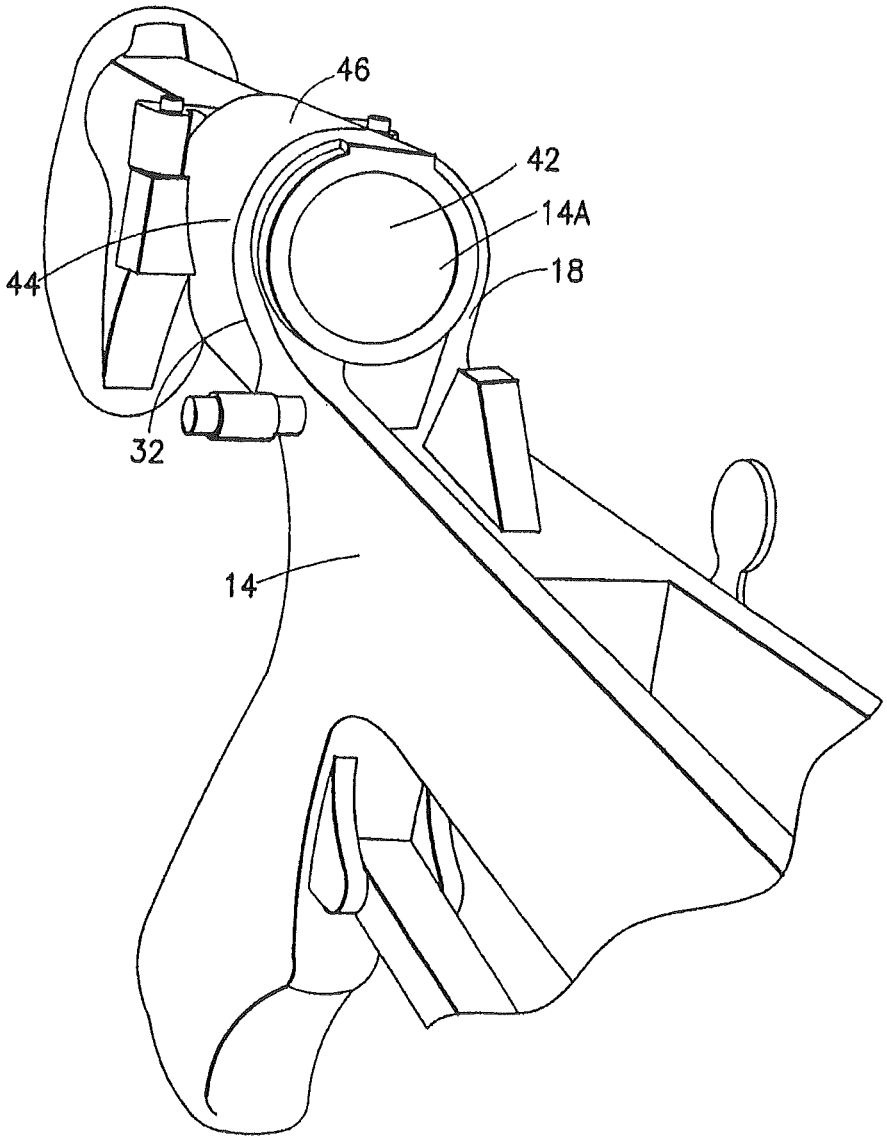
FIG. 4A is a view of an automatic firearm with a folding stock.

Referring now to FIG. 3, there is shown another side elevation view of the firearm 10 with the upper receiver disassembled from the lower receiver 14, and the bolt carrier 22 and bolt carrier return or action system 30 outside the firearm. As may realized, the bolt carrier 22 is movably mounted inside the upper receiver 16. The action system 30 is interfaced with and engages the bolt carrier to return the carrier 22 to its battery position during each operating cycle. In the exemplary embodiment, the bolt carrier action system 30 has an action spring(s) 38 (one spring is shown for example though there may be any number of action springs arranged in any desired configuration, parallel, series, and any suitable resilient system may be used including pneumatic springs) and a buffer 40 as will be described further below. The action system 30 may be housed, at least in part, within the base portion 32 of the stock 18. Referring also to FIGS. 4-4A, there is shown respectively a partial left elevation view of the firearm lower receiver 14 and stock 18, and a partial front elevation of lower receiver and stock. As will be described in greater detail below, the stock base portion 32, connecting the stock 18 to the rear end of the lower receiver, generally included a receiver extension member 42, a base 44 and a stock base housing 44. In alternate embodiments, the base portion may have any other desired configuration. In the exemplary embodiment, the receiver extension member 42 is communicably connected to the lower receiver 14. The receiver extension member 42 is located in the base 44, and the base is located within the stock base housing 44, as will also be described further below.

Figure 5:
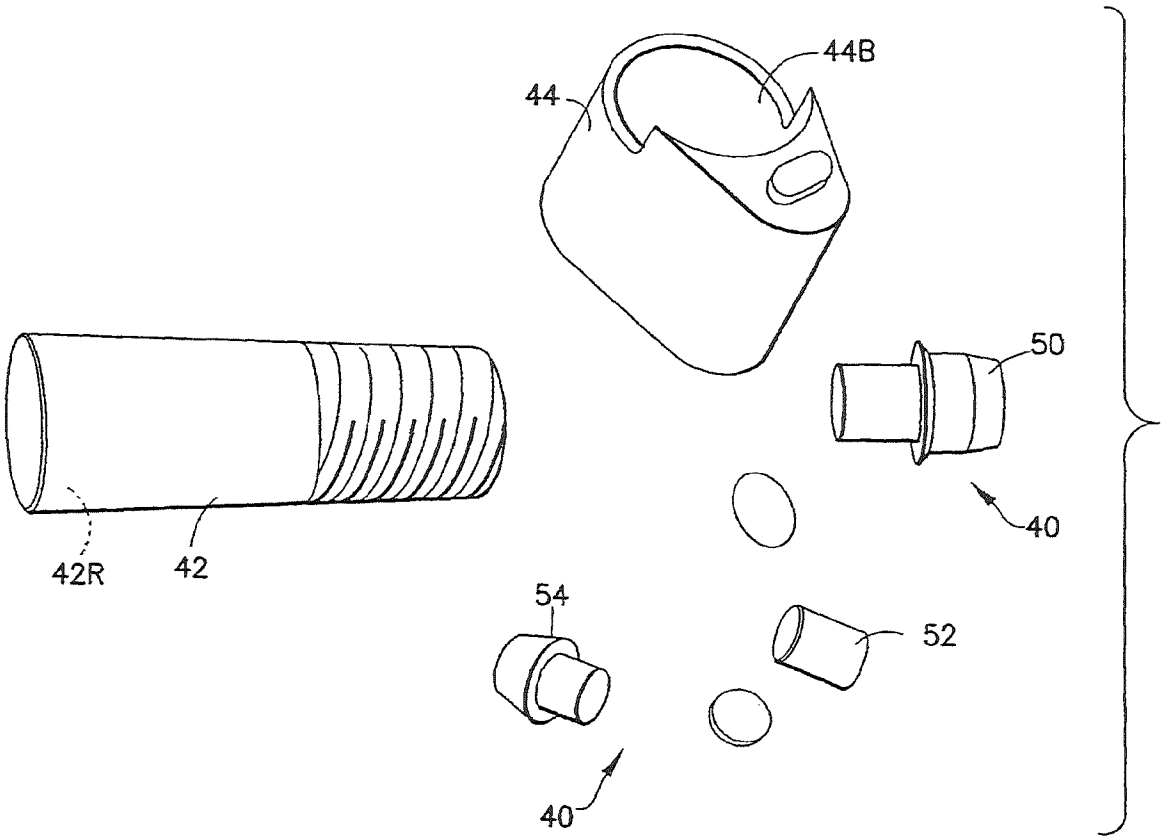
FIG. 5 is an exploded view of an extension assembly of the firearm.
Figure 5A:
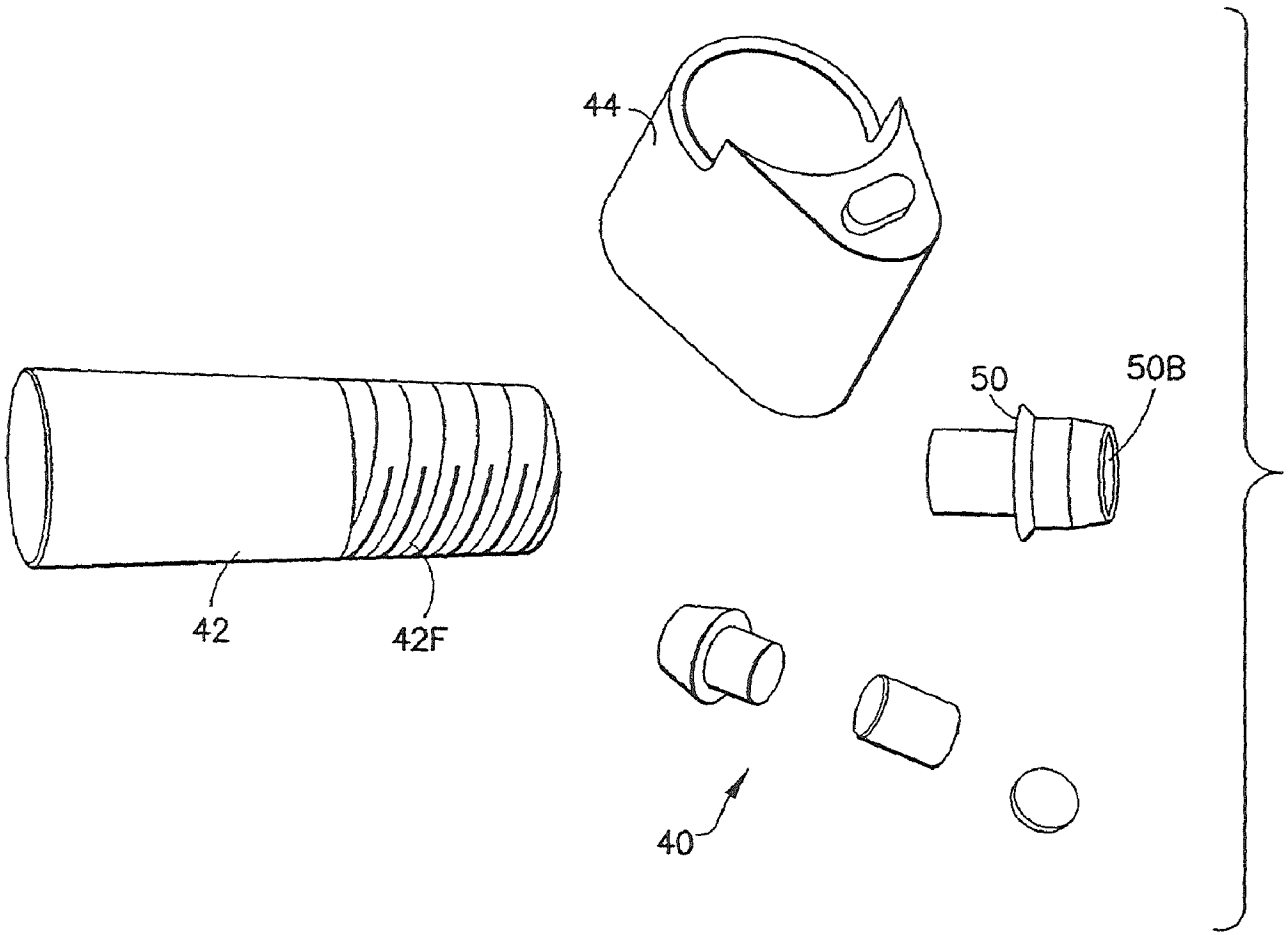
FIG. 5A is a view of the extension assembly.

The receiver extension 42 and base 44, in the exemplary embodiment, are shown in FIGS. 5-5A. FIGS. 5-5A also illustrate the buffer 40 of the exemplary embodiment in a disassembled condition. In the exemplary embodiment, the receiver extension member 42 may have a generally hollow cylindrical shape. The receiver extension member is sized and shaped to house and allow desired movement of the bolt carrier action system 30 and bolt carrier 22 as the bolt carrier is cycled during operation of the firearm. In alternate embodiments, the receiver extension member may have any other desired shape. In the exemplary embodiment, the bore within the receiver extension member 42 may be sized to stably support the helical action spring 38, of the bolt carrier action system 30 (see also FIG. 3) and allow unimpaired deflection of the spring as the bolt carrier cycles. As noted before, in alternate embodiments any suitable spring or bolt carrier return system may be used. The bore may also define a guideway for movement of the buffer 40 and bolt carrier 22 when the bolt carrier cycles during operation of the firearm. In the exemplary embodiment, the rear of the receiver extension member has a support surface 42R against which the action spring 38 may be biased as desired. In the exemplary embodiment shown in FIGS. 5-5A, the extension member 42 has an end cap or flange, with a vent opening therein, for maintaining desired pressure within the receiver and extension member as the bolt carrier is cycled during firearm operation. In alternate embodiment, the extension member, may be provided with a regulator, communicating with the receiver, to allow immediate firing after water submersion regardless of weapon orientation. A suitable example of a receiver extension regulator is described in U.S. patent application Ser. No. 11/026,142 filed on Dec. 30, 2004, incorporated by reference herein in its entirety.

As seen best in FIG. 5A, in the exemplary embodiment the extension member 42 may have a threaded portion 42F at its front end for engagement to the receiver 14 of the firearm (see also FIGS. 4-4A). As noted before, the firearm lower receiver 14 may have features similar to the lower receiver of an M4™ rifle available from Colt Defense, LLC. As seen in FIGS. 4-4A, the lower receiver may for example have an aperture 14A, that may be substantially in line with the bolt carrier (and bolt carrier action) when the bolt carrier is installed in the assembled receiver, and that allows engagement of the receiver extension member to the receiver. In the exemplary embodiment, the receiver aperture 14A may have internal threads allowing the extension member 42 to be threaded into the aperture, thereby mounting the extension member 42, and the stock 18 as will be described below, to the receiver. In alternate embodiments, the extension member may be mounted to the receiver in any other desired manner. As seen best in FIG. 4, in the exemplary embodiment, the extension member 42 may be rotationally locked to the receiver by locking ring 17, and locking collar 15. The ring 17 may be fixed rotationally to the extension member when the extension member is sufficiently threaded in the receiver aperture. The locking ring 17 may also be rotationally fixed to the locking collar 15, that is in turn fixed to the receiver (for example by threading the locking ring on the extension member causing engagement between locking detents on the ring, collar and the receiver). As may be realized, the extension member 42 in the exemplary embodiment is substantially shorter than a conventional receiver extension tube of a "black rifle" such as an M4™ rifle. The extension member 42 is sized so that in cooperation with the action system 30, it allows the desired action of the bolt carrier action system 30 and bolt carrier 22 at a desired cycle rate when operating the firearm. For example, the rifle 10 may have a cycle rate similar to the cycle rate of an M4™ rifle. In alternate embodiments, the firearm may have any other desired cycle rate. In the exemplary embodiment the extension member 42 may have a minimum length of about 3.3", though in alternate embodiments, the extension member may have a length that is more or less.

Figure 7:
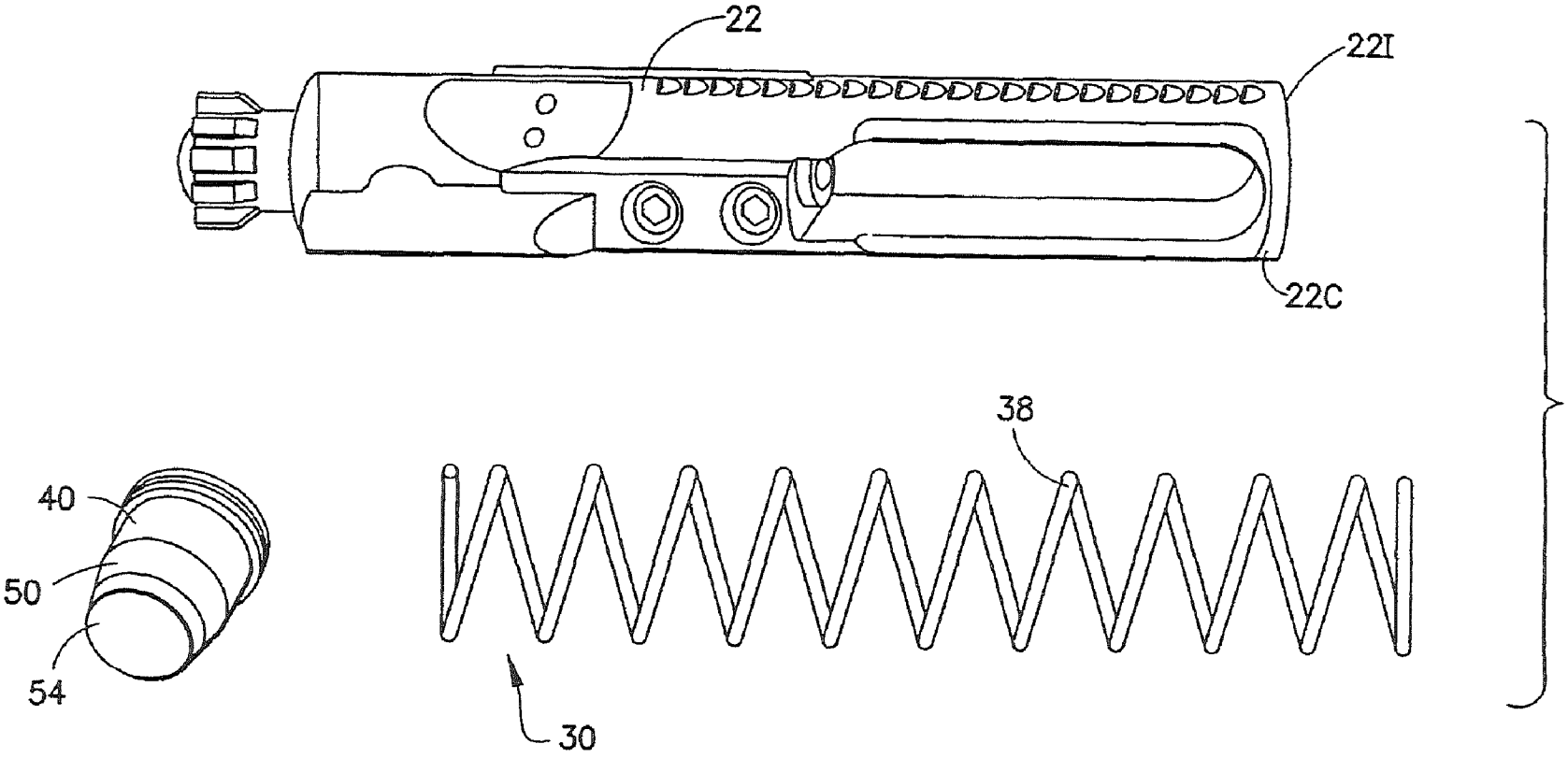
FIG. 7 is an exploded view of a bolt carrier and action system of a firearm.
Figure 7A:
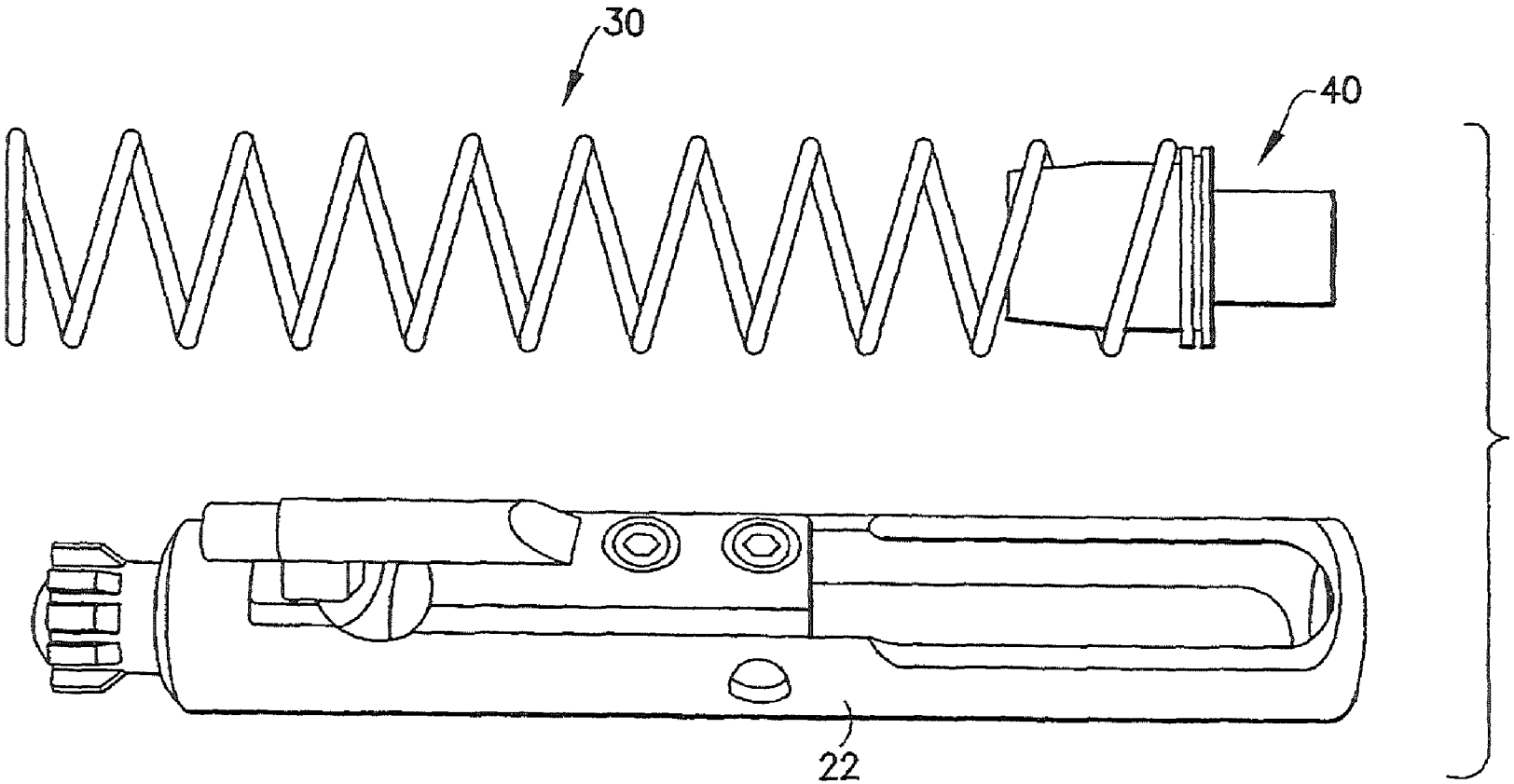
FIG. 7A is a view of a bolt carrier and action system.
Figure 7B:
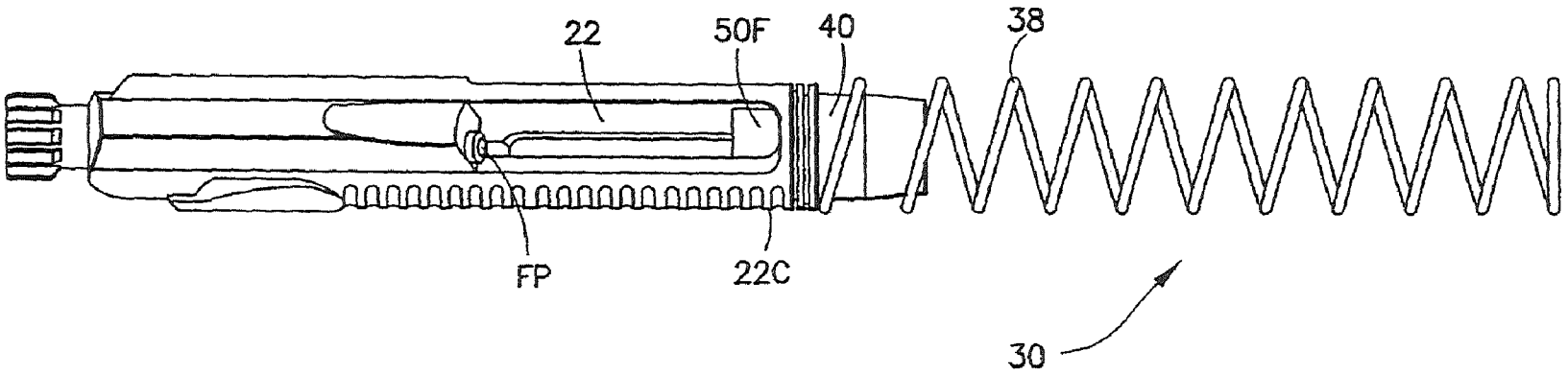
FIG. 7B is a view of a bolt carrier and action system.

Referring now again to FIG. 3, the bolt carrier 22 and bolt carrier action system 30 are shown in an assembled condition. Referring also to FIGS. 7-7B, there is respectively shown different views of the bolt carrier 22 and bolt carrier action system 30 in various states or disassembly. As noted before, and seen best in Figs. and 7B, the bolt carrier actions system 30 has an action spring 38 and buffer 40 that operate on the bolt carrier 22. In the exemplary embodiment, the action system 30 and bolt carrier 22 are compact, relative to the conventional bolt carrier and action system of an M4™ rifle, in order to operate with the compact receiver extension member 42 described before. The bolt carrier 22 in the exemplary embodiment may have features similar to the bolt carrier of a M4™ rifle except as otherwise noted. The bolt carrier 22 may have an interface 221 (see FIGS. 7-7B) that interfaces the bolt carrier 22 to the action system 30. In the exemplary embodiment, the bolt carrier 22 may have a buffer coupling 22*c* at the rear that allows coupling between the bolt carrier 22 and buffer 40 and hence the action system 30. The coupling 22C may include a buffer receiving aperture/opening sized and shaped for receiving a portion of the buffer 40 as will be described further below. The coupling 22C may also include seating surfaces for seating the buffer, along the axial direction of the bolt carrier, against the bolt carrier. In the exemplary embodiment, the bolt carrier 22 may have a rear ring that defines the buffer receiving aperture and buffer seating surface(s) of the coupling 22C. In alternate embodiments, the buffer coupling on the bolt carrier may have any other desired configuration.

Figure 6:
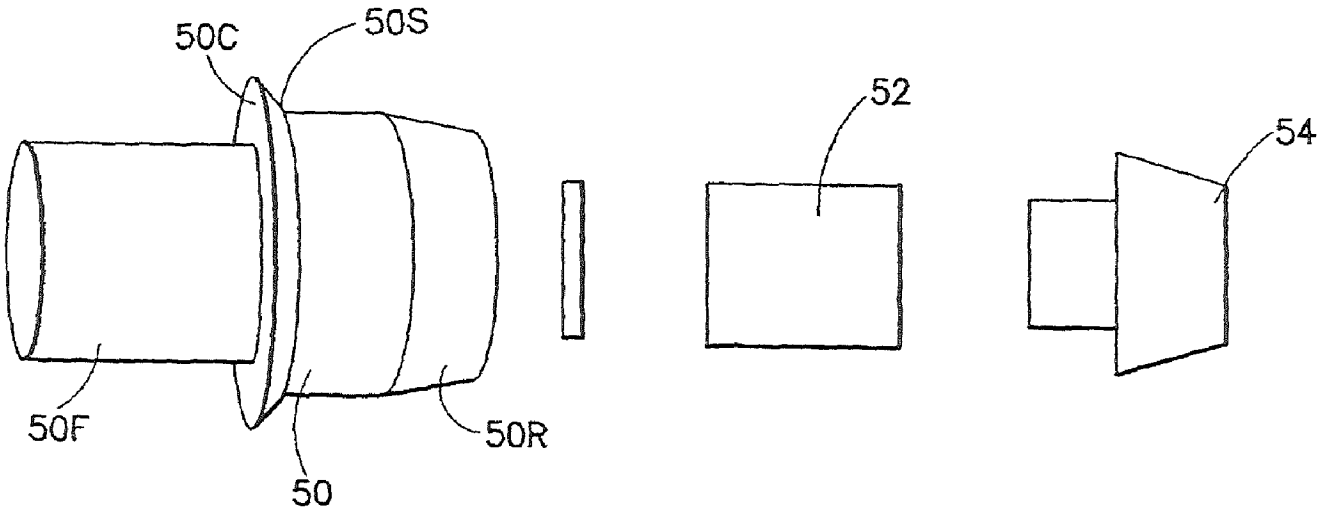
FIG. 6 is an exploded view of elements of a buffer assembly of the firearm.

Still referring to FIGS. 7-7B, in the exemplary embodiment action spring(s) 38 (as one or more may be used) may have a generally helical shape. The action spring 38 may be sized as desired to provide in cooperation with the buffer 40 suitable action to the bolt carrier 221 in view of the length of the receiver extension member 42 and size and mass of the bolt carrier 22. In alternate embodiments any suitable bolt carrier action spring or return system may be used. In the exemplary embodiment, the buffer 40 may be an assembly including an outer casing 50, interior mass 52 and cap 54. The disassembled elements 50-54 of the buffer assembly 40 are shown in FIGS. 5-5A, and 6, and the assembled buffer 40 is seen best in FIGS. 7-7A. In the exemplary embodiment, the casing 50 may be a one-piece member (i.e. unitary construction) made of metal such as 4140 steel, though any other suitable materials (for example including non metallic materials) may be used for forming the casing. In alternate embodiments, the buffer casing may be made in any other desired manner. As seen best in FIG. 6, in the exemplary embodiment the casing may have a front portion 50F, a midportion and rear portion 50R. The front portion 50F is sized and shaped (in the exemplary embodiment shown the front portion may be generally cylindrical) to conform with the buffer receiving opening in the coupling 22C of the bolt carrier. As may be realized, the front section 50F of the buffer 40 may thus be inserted into and stably held within the bolt carrier coupling 22C as seen in FIG. 7B. Thus, the buffer may be entrant, at least in part in the belt carrier. The casing 50 may have stops 50C that seat against seating surfaces on the bolt carrier to position the front portion 50F of the buffer 40 axially relative to the bolt carrier. As may be realized from FIG. 7B, the length of the front section is sized so that when coupled to the bolt carrier, the front portion 50F extending in the bolt carrier is positioned to avoid interfering with the action of the hammer (not shown) operating against the firing pin FP. As seen in FIG. 6, in the exemplary embodiment the casing may have a shoulder or flange defining stops 50C. In alternate embodiments, the stops on the casing may be formed in any desired manner. The rear portion 50R is generally configured so that the coils of action spring 38 may be positioned around the rear portion of the buffer. In alternate embodiments, the rear portion of the buffer may have any desired shape. The casing may also include seating surfaces 50S for axial seating the spring 38 against the buffer casing. The seating surfaces 50S may be generally opposed to stops 50C. As may be realized, when assembled (as shown in FIG. 3) the action spring 38 is biased against seating surfaces 50S in turn biasing the buffer via contact surfaces 50C against the buffer. As seen best in FIG. 5A, in the exemplary embodiment the casing 50 may have an inner chamber/bore 50B. The bore 50B is sized to slidably hold mass 52 therein. Mass 52 may be made of tungsten or any other suitable material (though one mass is shown in alternate embodiments the buffer may have more masses). The mass 52 and bore 50B are sized to allow the mass to slide freely, but substantially axially, within the bore 50B. The sliding mass 52 inside the casing defines a further inertia capacitor to the bolt carrier delivering an impulse load to the bolt carrier upon its return to the battery position by the action system. The bore 50B may have an opening at the rear end, through which the mass may be placed inside the casing bore and which is capped with cap 54. As noted before, the action system 30 is positioned in the firearm with the rear of the action spring 38 located in the receiver extension member 42, seated against the end 42R of the extension member 42. The upper and lower receivers 16, 14 may be coupled (with the bolt carrier 22 housed in the upper receiver), the buffer and action spring being resiliently moved to the rear to clear the upper receiver frame and bolt carrier during coupling. On coupling of the upper and lower receivers, the buffer 40 (biased by spring 38) automatically engages and couples with the bolt carrier 22. As may be realized the compact receiver extension 42, bolt carrier 22 and action system 30, in the exemplary embodiment results in the action spring 38 and the support surface 42R supporting the spring, and the action loads imparted thereby, being located closer to the center of mass of the firearm, and to the ergonomic hand grips. This contributes to improved stability and reduced reaction forces on the user when operating the firearm 10 compared to conventional rifles.

Referring again to FIGS. 5-5A, the base 44 has a bore 44B formed therein allowing the base to be mounted to the receiver extension 42. In the exemplary embodiment, the base forms a mounting interface or bracket for mounting the base housing 46 of the stock 18 to the receiver extension 42 and hence, the firearm. The base 44 in the exemplary embodiment shown in the figures has a representative configuration and in alternate embodiments, the base may have any other desired arrangement. The base may be made from any suitable material such as aluminum and may be of unitary construction. The base 44 may be fixed to the receiver extension 42 for example, by a takedown pin engaging a detent on the receiver extension, or any other desired position fixing devices/features. As seen in FIG. 5, in the exemplary embodiment the base may have a recess generally conforming to the locking ring 17 on the receiver extension (see FIG. 4). In the exemplary embodiment, the base may have locating features (e.g. detents) to positionably locate the base with respect to the firearm receiver.

Referring now again to FIGS. 2-2D, and 4-4E, in the exemplary embodiment the stock base housing 46 is mounted to the stock base 44. In the exemplary embodiment the stock base housing 46 may be a one piece member, made of suitable material such as a non-metallic material (e.g. plastic). The stock base housing 46 may have a suitable interior passage or opening, for example conforming to the shape of the base 44, and allowing the stock base housing 46 to be mounted to the base by for example sliding the stock base housing over the base. The base 44 and housing 46 may be provided with suitable interlocking detents (e.g. lock pin and receptacle) to fix the housing to the base. The interlocking detents may be spring loaded for automatic engagement. In alternate embodiments, the base and housing may be formed as a one piece member (i.e. of unitary construction). In alternate embodiments, the base and housing may have interlocking detents with more than one selectable position allowing for example telescoping position between housing and base for a stock base of selectable variable length. As noted before the shape of the stock base housing 46 in the illustrated embodiments is merely exemplary, and in alternate embodiments the stock base housing may have any other suitable shape.

Figure 4B:
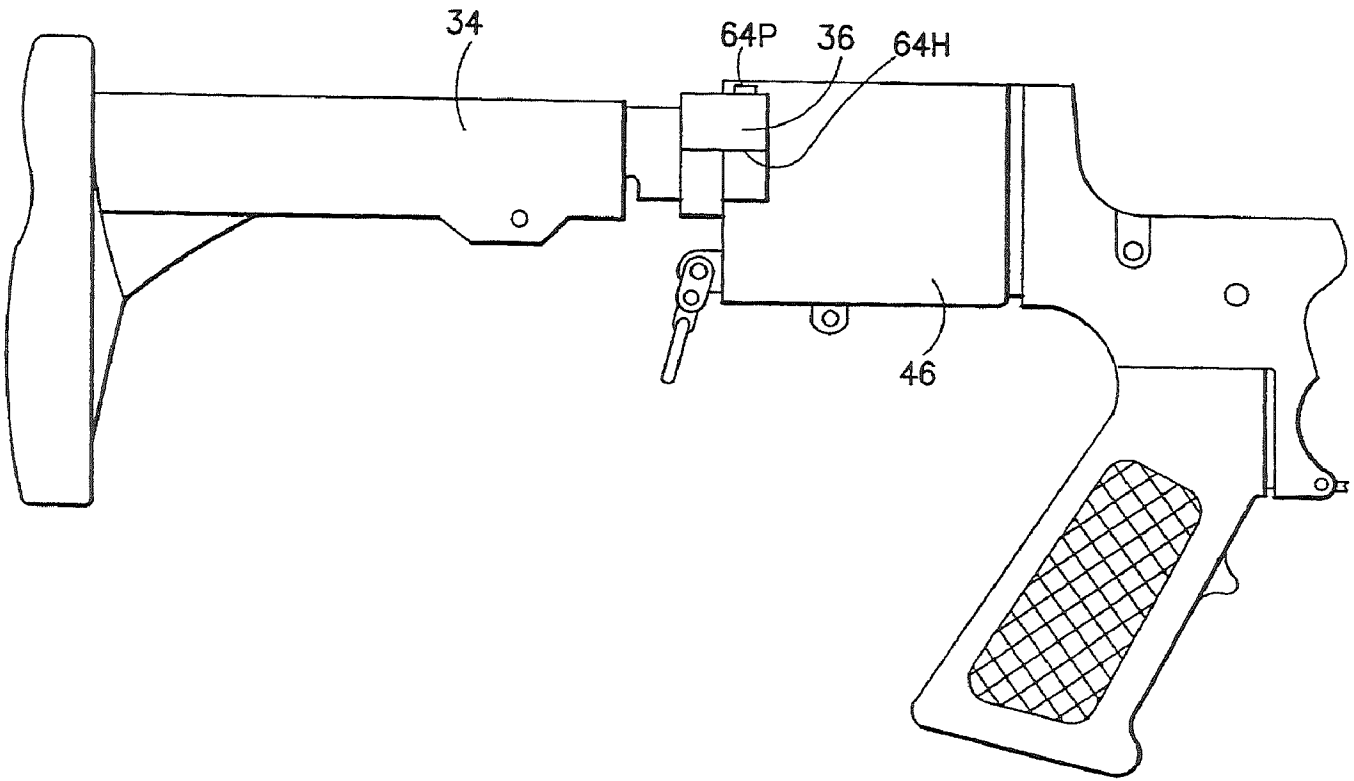
FIG. 4B is a side view of an automatic firearm with a folding stock.
Figure 4C:
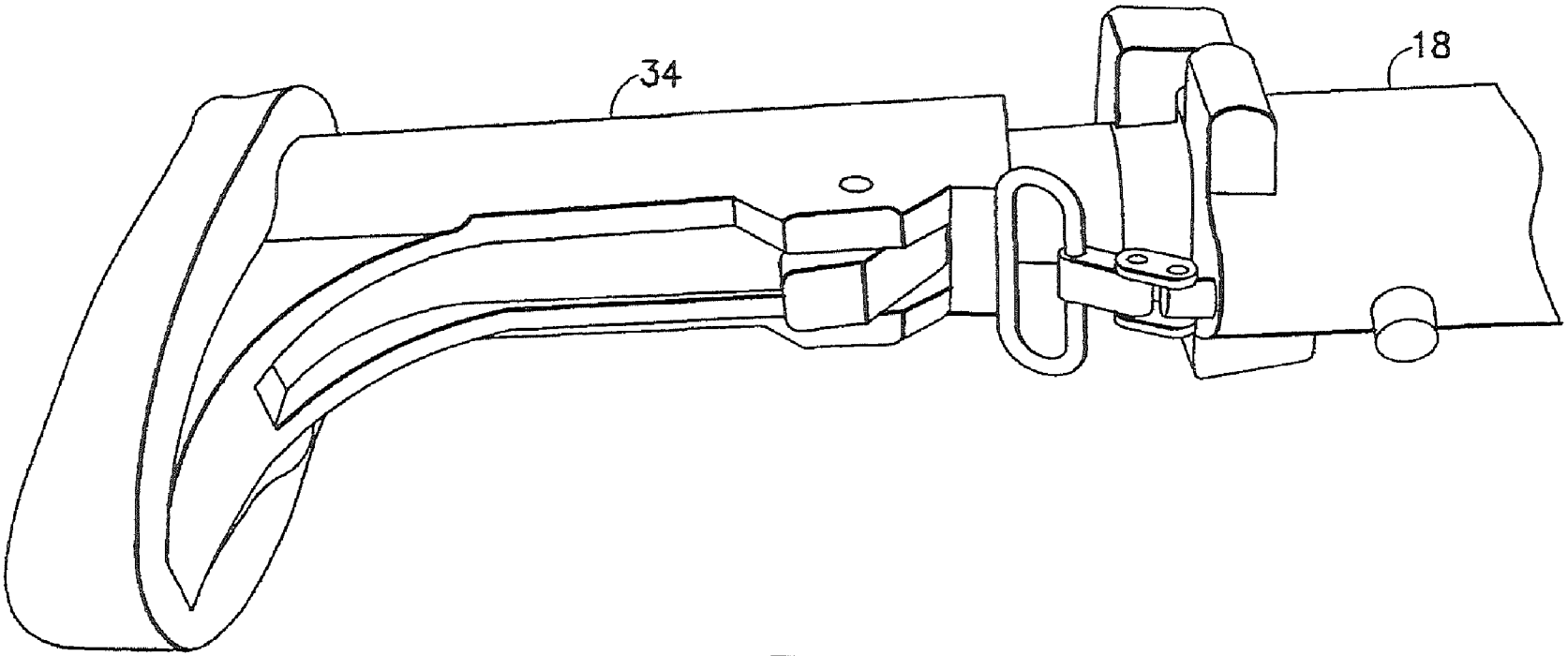
FIG. 4C is a isometric view of an automatic firearm with a folding stock.
Figure 4D:
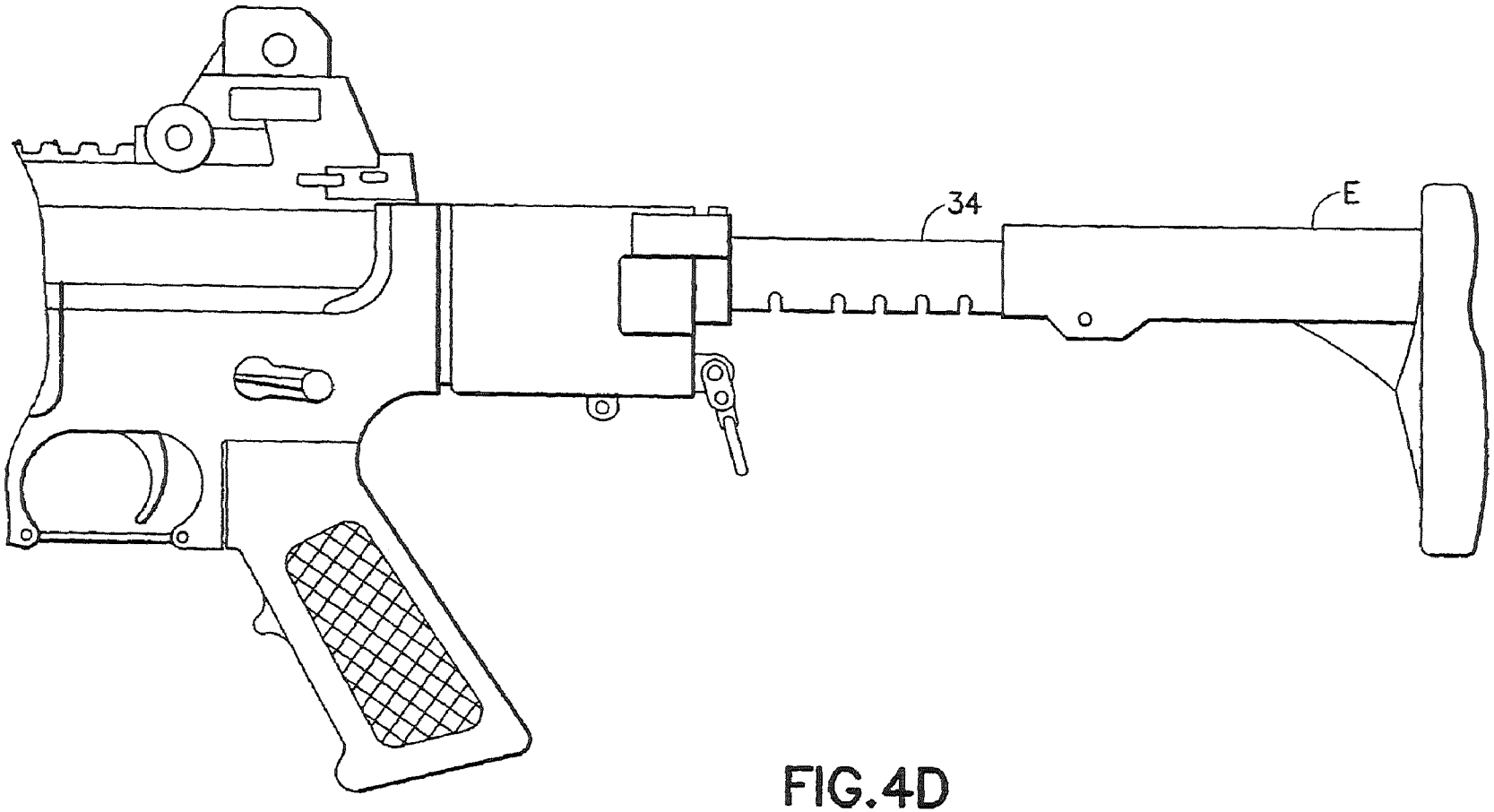
FIG. 4D is a side view of an automatic firearm with a folding stock shown in still another position.
Figure 4E:
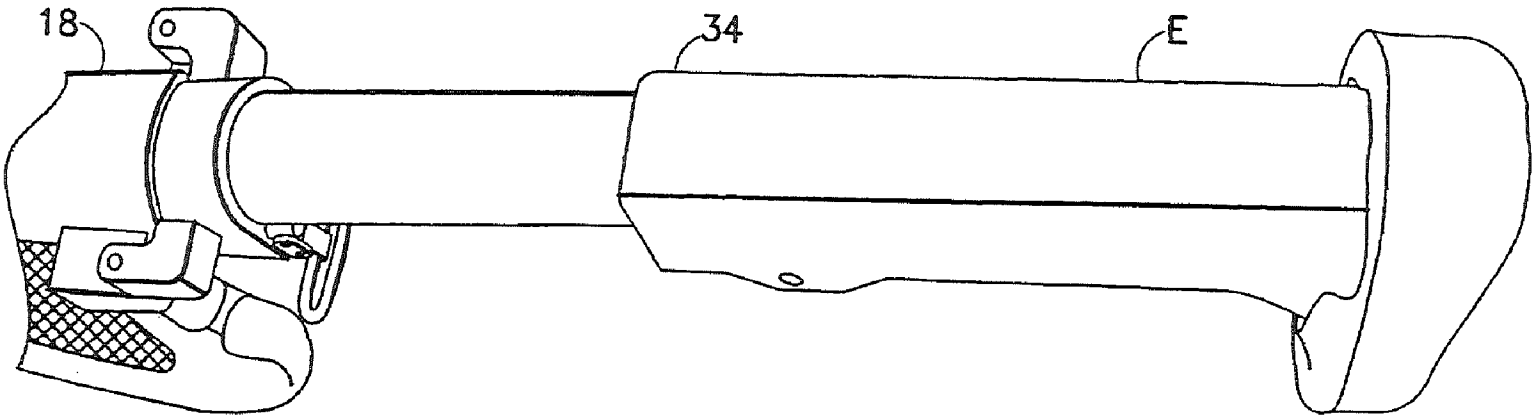
FIG. 4E is a view of an automatic firearm with a folding stock in the still other position.

As seen best in FIGS. 2, 2B and 4, 4B, coupling 36 connects the end or folding portion 34 of the stock 18 to the base portion 32 and particularly in the exemplary embodiment, to the stock base housing 46. FIGS. 2, 2B show the stock 18 in the folded position, and FIGS. 4, 4B illustrate the stock in the deployed or unfolded position. In the exemplary embodiment, coupling 36 incorporates a single degree of freedom, (e.g. a single axis of rotation R as shown in FIG. 4). In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the folding stock portion 34 from the stock base 32. The configuration of the coupling 36 in the illustrated embodiments is merely exemplary, and in alternate embodiments the coupling may have any other suitable configuration. In the exemplary embodiment, the coupling 36 may have a hinge 60 (see FIG. 4) located to allow the folding portion to be rotated to the left side. Spring loaded detents 62P, 62A engage automatically to lock the folding portion in its folded position. A push pin is provided in the exemplary embodiment to disengage the detents and unlock the folding portion from its folded position. Interfacing seating surfaces on the folding portion and stock base housing fix the folding portion to the base when the folding portion is in its deployed position (see FIGS. 4, 4B). In the exemplary embodiment, spring loaded detents 64P, 64H (see FIG. 4B) engage automatically to lock the folding portion in its deployed position. A push pin is provided in the exemplary embodiment to disengage the detents, and unlock the folding portion from its deployed position. As noted before, in the exemplary embodiment the folding portion 34 incorporates a telescoping system allowing the folding portion to have a selectably variable length. The length of the folding portion may be adjusted/selected as desired with the folding portion in either the folded or deployed positions (see FIGS. 2A, 2D and 4B, 4D). As seen best in FIG. 2*a*, the folding portion 34 is shaped so that the operating mode selector 26 is readily accessible by the operator when the folding portion 34 is in its folded position and telescoped in (i.e. min. length). The operator may thus easily operate the firearm with the stock in any position. As may be realized, any M4™ rifle may be configured in accordance with the exemplary embodiments as described above by replacing the conventional bolt carrier, action system and stock with the bolt carrier 22, action system 30 and stock 18 of the exemplary embodiment.

Figure 8:
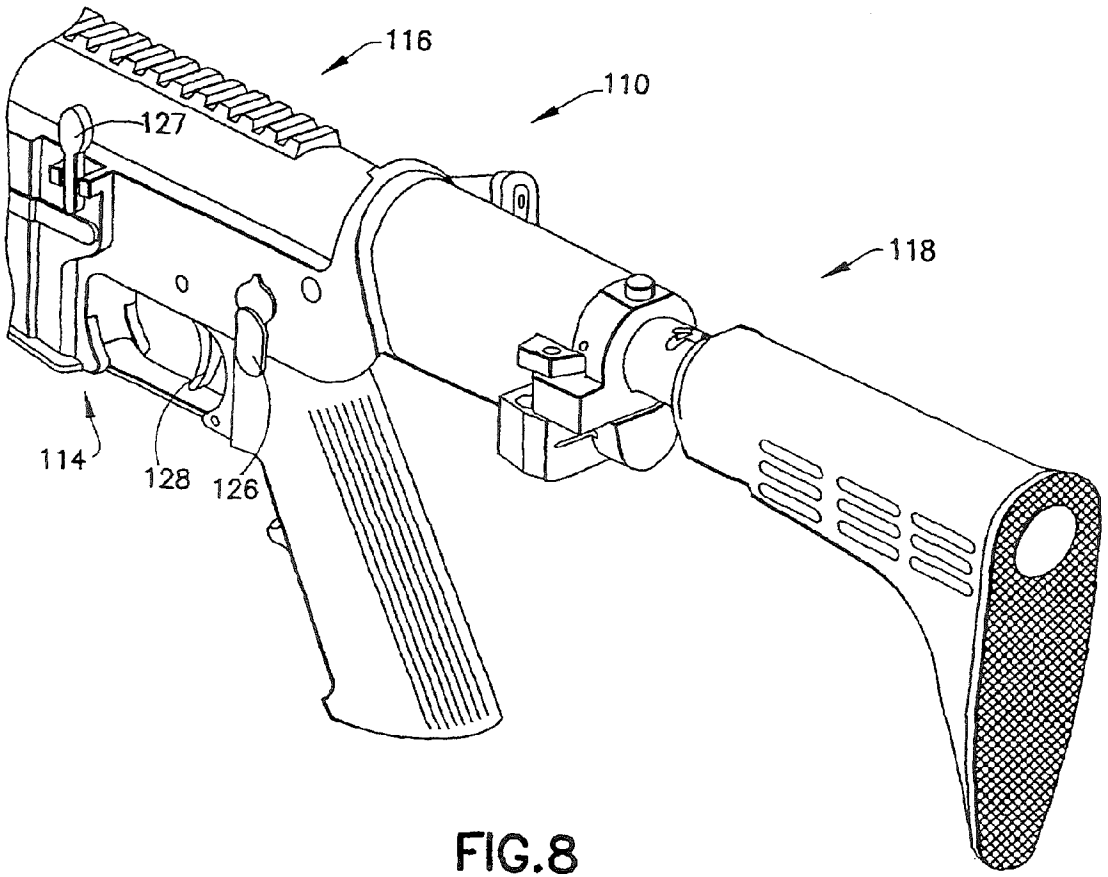
FIG. 8 is a partial isometric view of an automatic firearm incorporating features in accordance with an exemplary embodiment.

Referring now to FIG. 8, there is shown a partial perspective view of a firearm 110 in accordance with another exemplary embodiment. Firearm 110 may be similar to firearm 10 described previously and shown in FIGS. 1-7, except as otherwise noted (and similar features are similarly numbered). The rifle 110 generally has a lower receiver 114, an upper receiver 116, a barrel (not shown) and stock 118. The firearm 110 may have a selector mechanism 126, that interfaces with the firearm trigger system 128 to allow operator selection between, for example "AUTO" (automatic) "SEMI" (semi-automatic) and "SAFE" (safety) operating modes. Cycling of the bolt carrier may be effected by the operating system (as noted before) in cooperation with a bolt carrier return system described in greater detail below. The bolt carrier return system may be located in the stock 118 of firearm 110. In the exemplary embodiment shown in FIG. 8, the stock 118 is a folding stock as will also be described in greater detail below. The stock 118 may also have a telescoping or extendable portion providing stock with selectably variable length.

Figure 9:
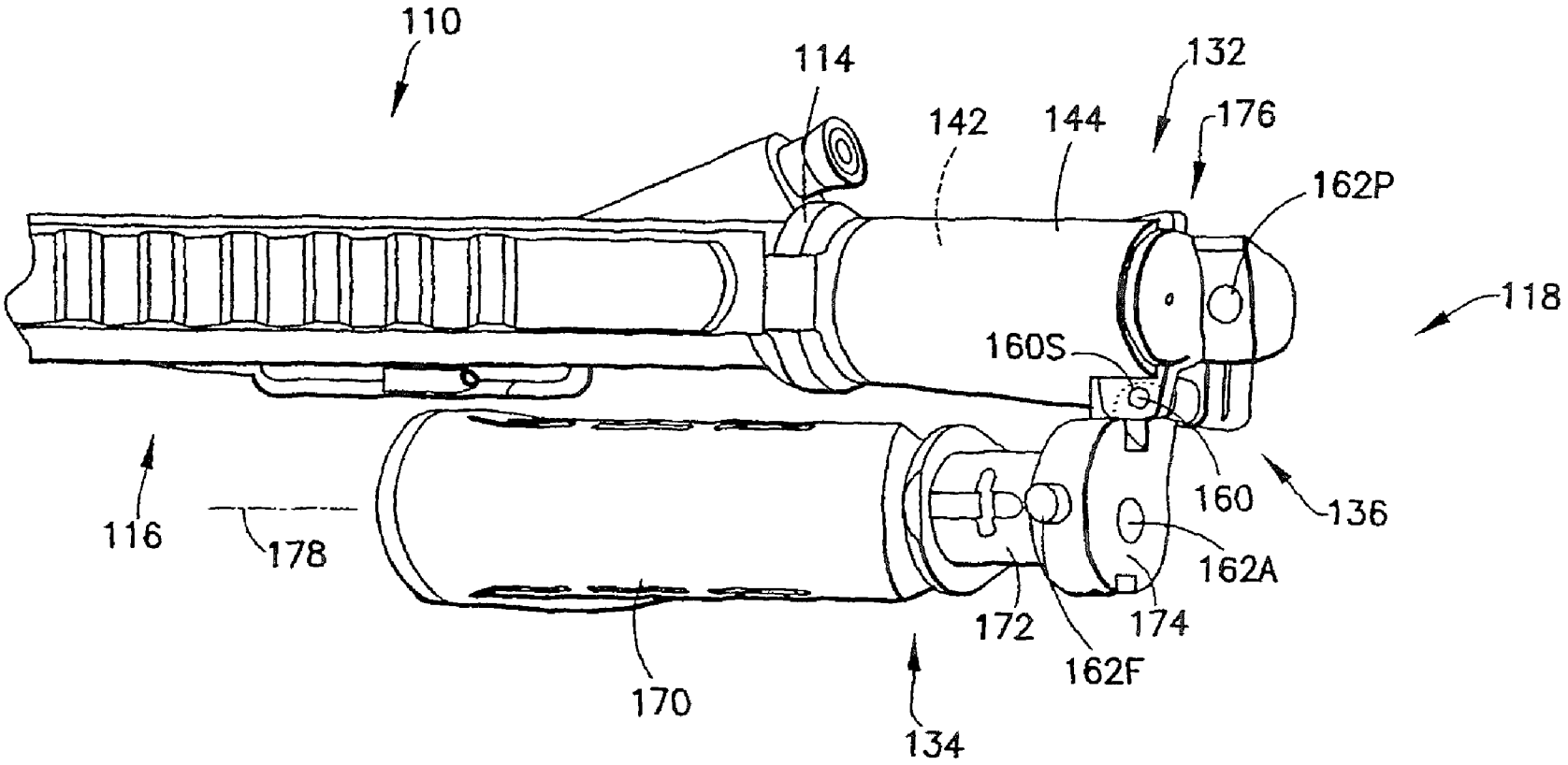
FIG. 9 is a top isometric view of an automatic firearm with a folding stock shown in one position.
Figure 10:
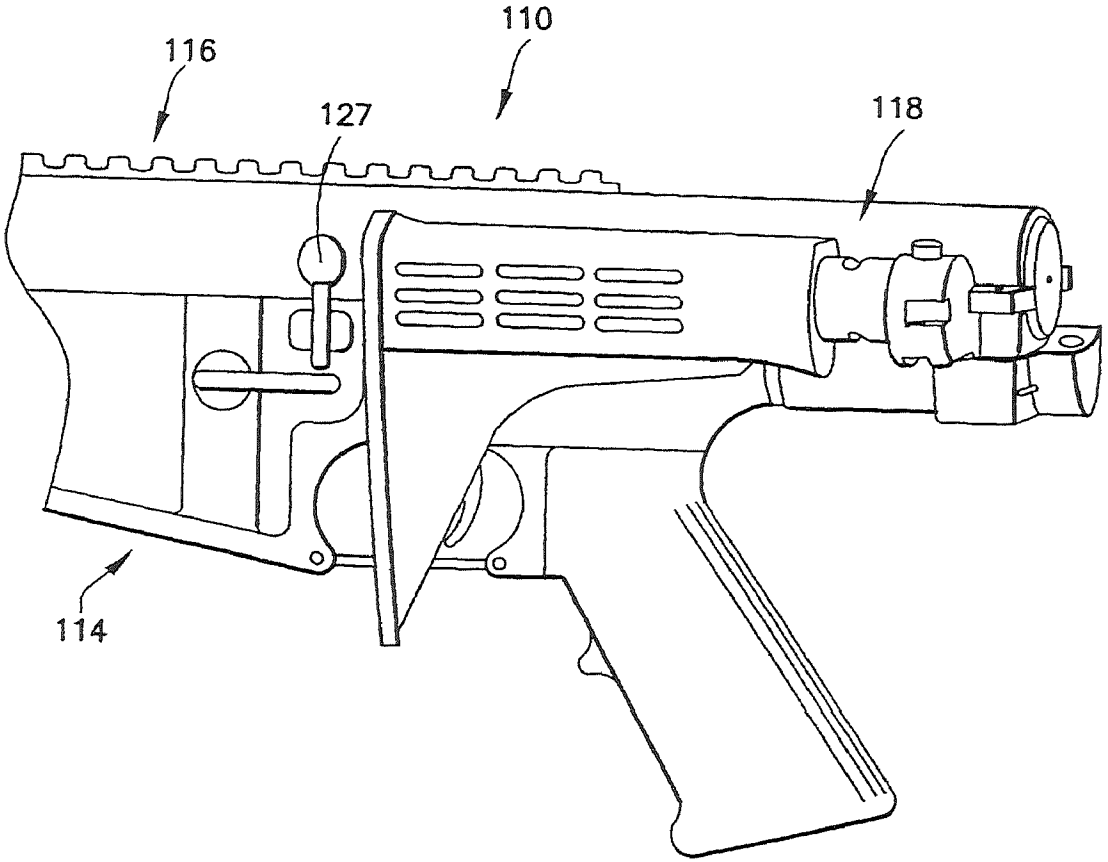
FIG. 10 is a side elevation view of an automatic firearm with a folding stock shown in the same position as in FIG. 9.
Figure 11:
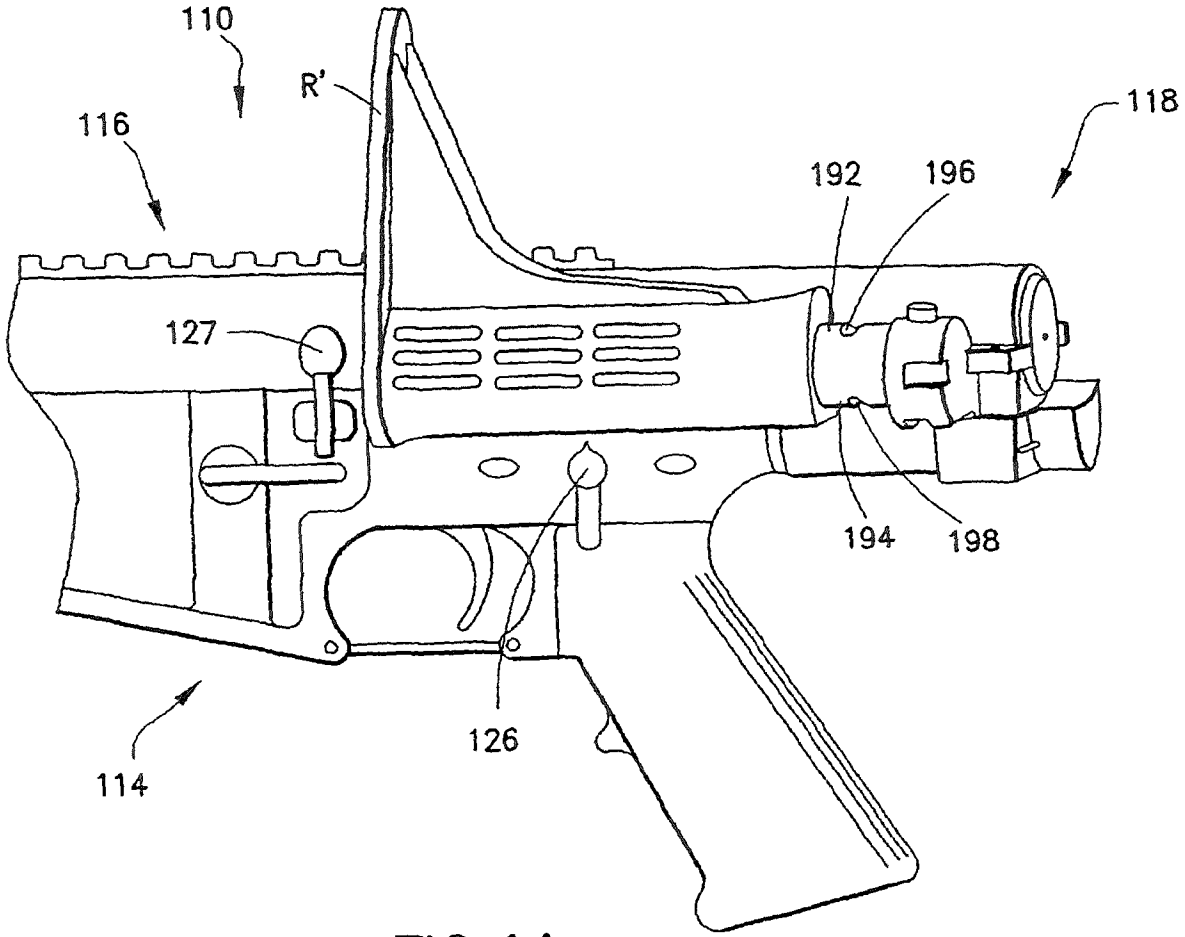
FIG. 11 is a side elevation view of an automatic firearm with a folding stock shown in still another position.
Figure 12:
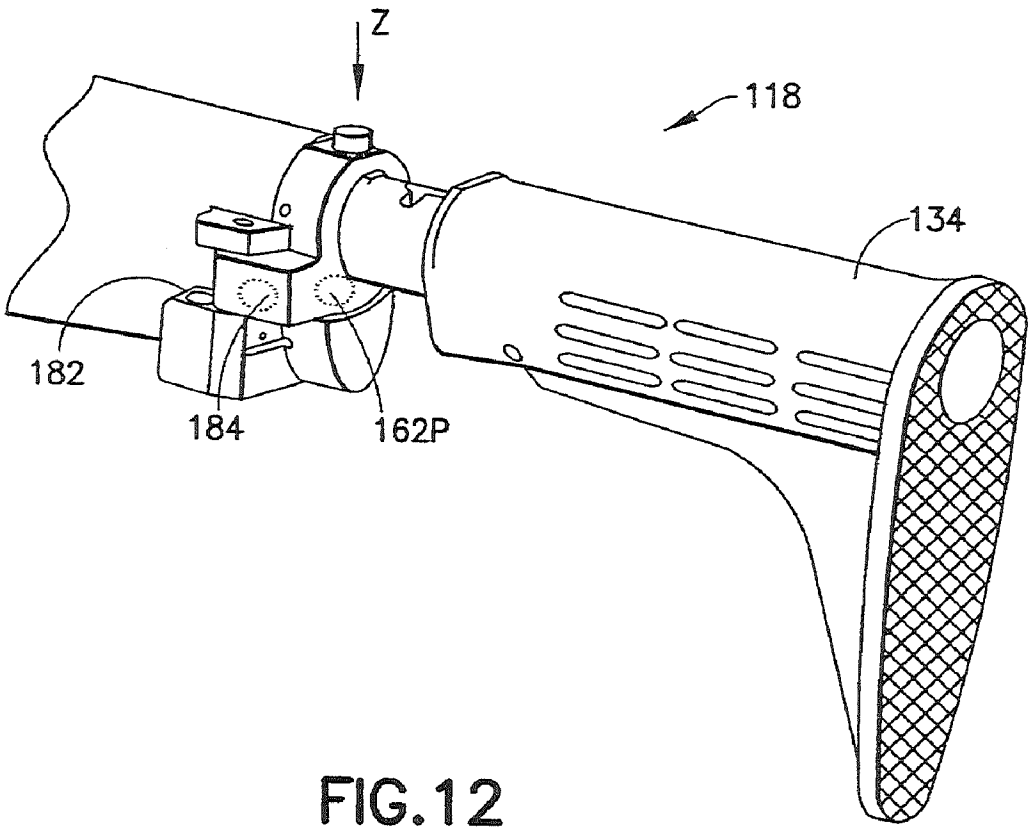
FIG. 12 is a side isometric view of a folding stock shown yet another position.
Figure 13:
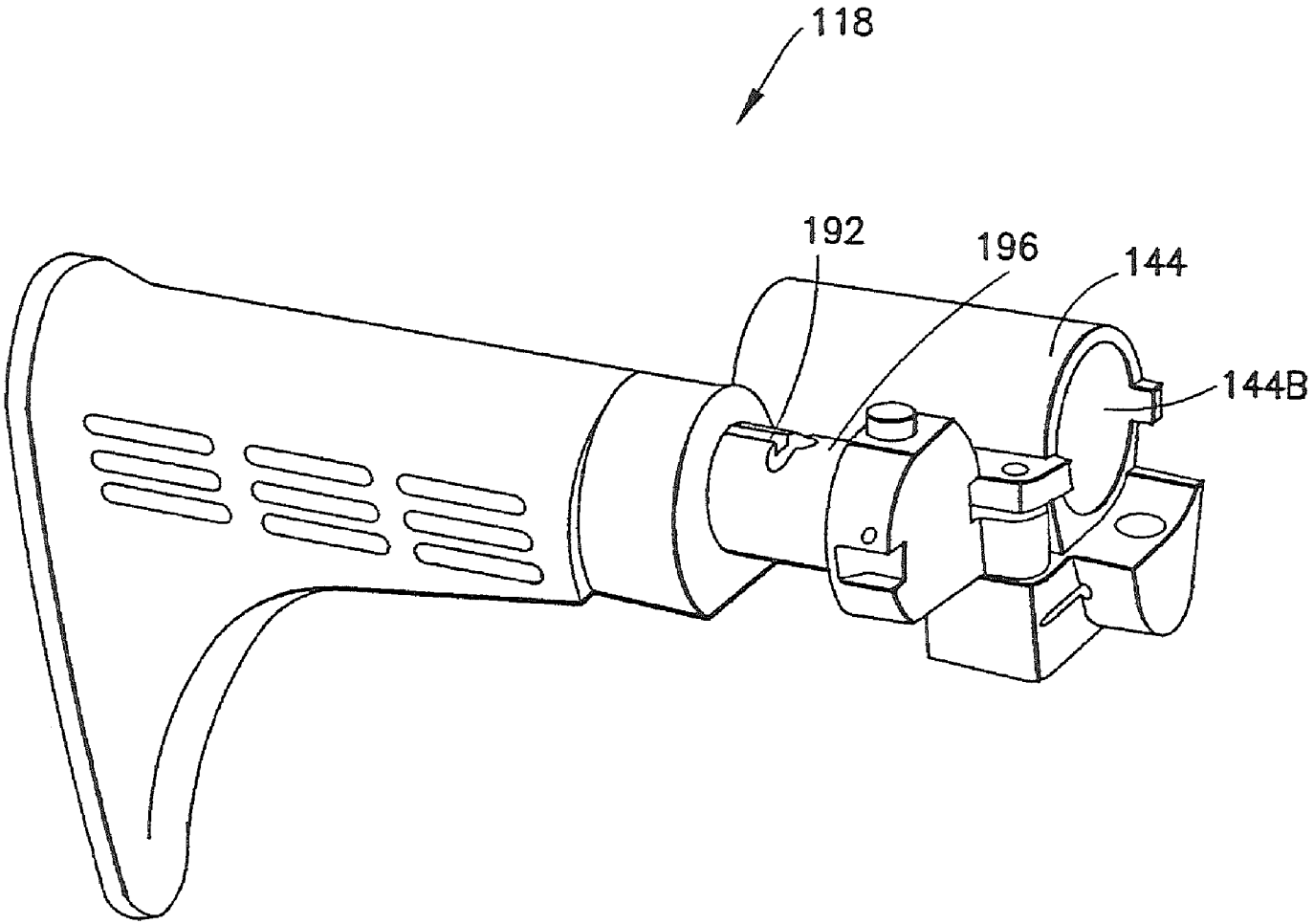
FIG. 13 is a isometric view of a folding stock.
Figure 14:
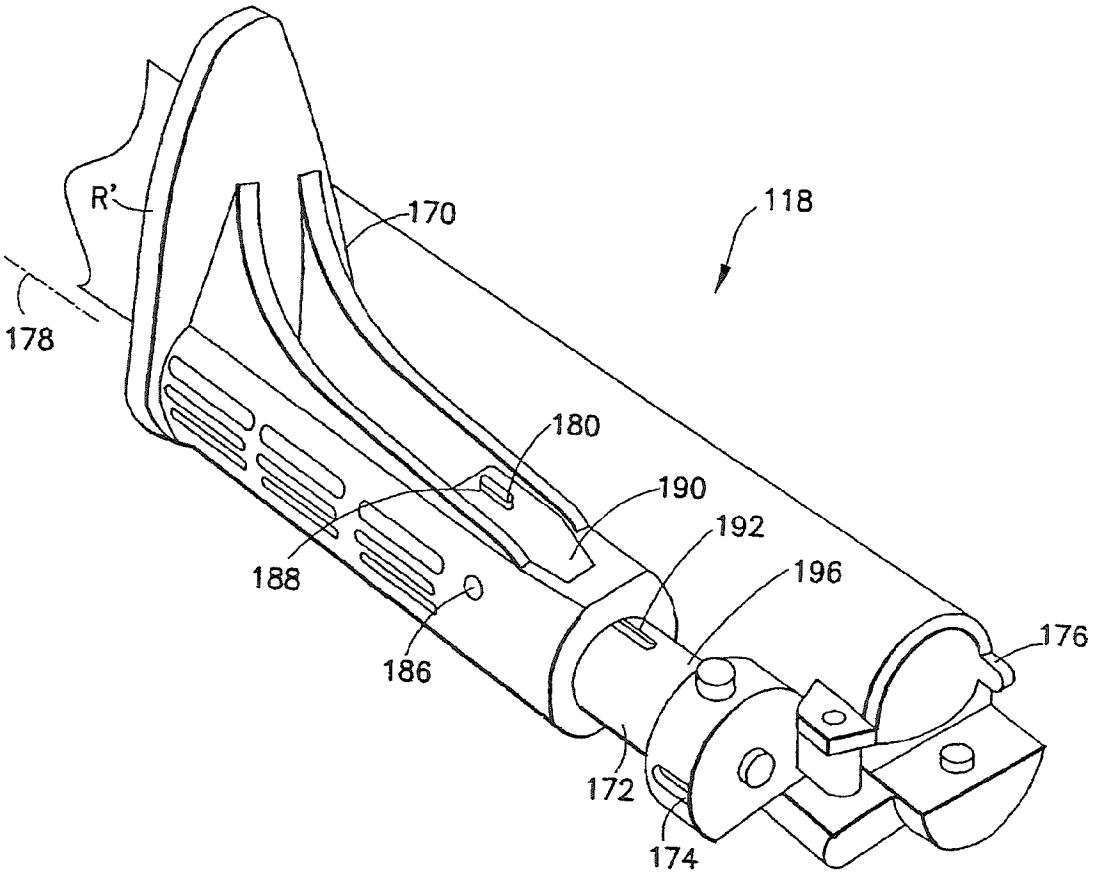
FIG. 14 is an isometric view of a folding stock shown in still yet another position.

Referring now to FIG. 9, there is shown a top isometric view of automatic firearm 110 with folding stock 118 in a folded position. Referring also to FIG. 10, there is shown a side elevation view of automatic firearm 110 with folding stock 118 in a folded position. Referring also to FIG. 11, there is shown another side elevation view of automatic firearm 110 with folding stock 118 in another folded position R'. Referring also to FIG. 12, there is shown a side isometric view of folding stock 118 in an extended position. Referring also to FIG. 13, there is shown a isometric view of folding stock 118 in folded position R'. Referring also to FIG. 14, there is shown an isometric view of folding stock 118 in a folded position. Stock 118 may have what may be generally referred to as a base portion 132 and folding portion 134. The base portion 132 of the stock 118, mates the stock to the lower receiver 114. In the exemplary embodiment, the folding portion 134 may be joined to the base portion 134 by a coupling 136 that allows the folding portion 134 to be folded, or rotated relative to the base portion 118 from a deployed position (or unfolded position as illustrated in FIG. 8 for example) to a folded or stowed position(s) (shown for example in FIGS. 9-11 and 13-14) as will be described further below. In the exemplary embodiment illustrated in the figures, the folding portion is shown for example folded on the left side of the firearm. In alternate embodiments, the folding portion of the stock may have more than one folded position. For example the folded portion of the stock may be folded down or on the right side of the firearm. In other alternate embodiments, the folding portion may be moved to any other desired folded position.

An action system (not shown) but similar to action system 30 described before) may be housed, at least in part, within the base portion 132 of the stock 118. The stock base portion 132, connecting the stock 118 to the rear end of the lower receiver houses a receiver extension member within a stock base housing 144. In alternate embodiments, the base portion may have any other desired configuration. In the exemplary embodiment, the receiver extension member may have a generally hollow cylindrical shape and may be sized and shaped to house and allow desired movement of the bolt carrier action system and bolt carrier as the bolt carrier is cycled during operation of the firearm. The bolt carrier and bolt carrier action system (e.g. buffer, recoil spring) may be similar to the exemplary embodiments described As can be seen in FIG. 13, base 144 has a bore 144B formed therein allowing the base to be mounted to the receiver extension 142 (see also FIG. 9). In the exemplary embodiment, the base forms a mounting interface or bracket for mounting the base housing 144 of the stock 118 to the receiver extension 142 and hence, the firearm. The base 144 in the exemplary embodiment shown in the figures has a representative configuration and in alternate embodiments, the base may have any other desired arrangement. The base may be made from any suitable material such as aluminum and may be of unitary construction. The base 144 may be fixed to the receiver extension 142, by any suitable means as will be described in greater detail below. In alternate embodiments the stock base 144 may be a one piece member, made of suitable material such as a non-metallic material (e.g. plastic). The stock base 144 may have a suitable interior passage or opening 144B, for example conforming to the shape of the receiver extension, and allowing the stock base 144 to be mounted to the extension for example by sliding the stock base over the extension. The base 144 and extension or lower receiver may be provided with suitable interlocking detents (e.g. lock pin and receptacle) to fix the base to the receiver. The interlocking detents may be spring loaded for automatic engagement. In alternate embodiments, any suitable fastening technique may be used. In alternate embodiments, the base may be formed as a multi piece member (i.e. instead of unitary construction, made of multiple components). In alternate embodiments, the base and lower receiver or extension may have interlocking detents with more than one selectable position allowing for example telescoping or rotational position between the receiver and base for a stock base of selectable variable length or rotational position. As noted before the shape of the stock base housing 144 in the illustrated embodiments is merely exemplary, and in alternate embodiments the stock base housing may have any other suitable shape.

Referring again to FIG. 9, coupling 136 connects the end or folding portion 134 of the stock 118 to the base portion 132 and particularly in the exemplary embodiment, to the stock base 144. In the exemplary embodiment, coupling 136 incorporates a single degree of freedom, for example, a single axis of rotation. In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the folding stock portion 134 from the stock base 132. The configuration of the coupling 136 in the illustrated embodiments is merely exemplary, and in alternate embodiments the coupling may have any other suitable configuration. In the exemplary embodiment, the coupling 136 may have a hinge 160 located to allow the folding portion to be rotated to the left side. In the exemplary embodiment, the folding portion 134 may be spring loaded in the folding position shown in FIG. 9. For example, a torsion spring 160S may be positioned between the folding portion 136 and base to bias the folding portion to the folded position. The spring may be configured as desired to generate sufficient bias to hold the folding portion 136 in the folded position throughout any desired operation of the firearm. In alternate embodiments, other hinge locations may be provided, for example, a center or left hand hinge location. In other exemplary embodiments, spring loaded detent 182 (see FIG. 12) may be provided on base portion 132 for mating portion 184 on folding portion 134 to hold the folding portion 134 in the folded position (see FIG. 12). As seen best in FIG. 9, spring loaded detents 162P, 162A engage automatically to lock the folding portion in its unfolded position (shown in FIG. 12). Push pin 162F is provided in the exemplary embodiment to disengage the detents and unlock the folding portion from its unfolded or deployed position. The arrangement of the spring loaded detents and push pin is merely exemplary.

The push pin 162F may be pressed in the direction indicated by arrow Z (in FIG. 12) pushing the push pin to engage detent 162P. As may be realized, the push pin deflects the detent causing it to disengage the folding portion and allowing folding stock portion 132 to be released. Interfacing seating surfaces 174, 176 (see FIG. 9) on the folding portion 134 in the exemplary embodiment and stock base housing 144 fix the folding portion 134 to the base 144 when the folding portion is in its deployed position. When folding portion 134 is in the deployed position, protrusion 176 is seated within mating slot 174 and providing additional structural support. In alternate embodiments, interfacing surfaces between folding portions 134 and base 144 may be provided in any desired arrangement for stably holding and positioning the folding portion when in the unfolded position. In the exemplary embodiment, spring loaded detent 162P engages mating recess 162A automatically to lock the folding portion in its deployed (unfolded) position.

As noted before, in the exemplary embodiment the folding portion 134 incorporates a telescoping system allowing the folding portion to have a selectably variable length. The length of the folding portion may be adjusted/selected as desired with the folding portion in either the folded or deployed positions. In the exemplary embodiment folding portion 134 has a rotatable butt stock or butt stock portion 170 capable of being rotated about extension tube or extension portion 172 about axis 178. Referring to FIG. 14, the stock 170 is shown rotated to a position R' that for convenience may be referred to as the up position. In the exemplary embodiment, the up position may be generally opposed to the position down position (such as shown in FIG. 12). In alternate embodiments the stock may have any other desired orientation when in the up position. The butt stock may include a release 180 shown best in FIG. 14 that may be spring loaded to a locked position. The release 180 locks the position of butt stock 170 to extension tube 172. In the example shown, release 180 pivots about pin 186 and may be depressed on its rear portion 188 to overcome the spring load. Upon pressing rear portion 188, engagement portion 190 is raised, disengaging mating features (similar to slot 196) on extension tube 172 and allowing butt stock 170 to be moved relative to extension tube 172. Here, butt stock 170 may be slid along extension tube 172 from a full back position (similar to positions E, E' shown in FIGS. 2D and 4D) to a full forward position (see FIG. 8) and may be rotated about axis 178, about 180 degrees between up and down positions. In the exemplary embodiment, Extension tube 172 may have both longitudinal top and bottom guide grooves 192, 194 and engagement slots 196, 198 allowing longitudinal and rotational positioning of butt stock 170 relative to extension tube 172. Here, the grooves 192, 194 in extension tube 172 may be located about 180 degrees apart, allowing 180 degree rotation of stock 170 about tube 172 where a mating feature on engagement portion 190 of spring loaded detent 180 engages the grooves 192, 194 in the butt stock 170. In alternate embodiments, more than two rotational positions or different rotational angles could be provided. In alternate embodiments, a detent may be provided in tube 172 and vice versa. Slots 194, 196 are provided on extension tube 172 intersecting grooves 192, 194 such as at about degrees and allow butt stock assembly 170 to be incrementally located on extension tube 172 or pulled off extension tube 172. Features are provided in latch or release 180 that engage slots 196, 198 allowing the butt stock to be locked in a selected position. Here, latch 180 provides a guide for rotational stability in fore and aft sliding. The butt stock may be located in either the up or down positions when the folding portion is in the unfolded position or in the folded position with the ability to rotate and lock in the up position. For example, shown in FIG. 14, butt stock 170 may be rotated up and flipped open, such as for a left hand user allowing easy access to trigger, fire selector 126 or bolt carrier release 127 (see FIG. 11) and can also be provided for a right hand user. For example, when butt stock 170 is rotated up, there is suitable access to the bolt release button and unobstructed access to the trigger from either left or right side. As may be realized, if the stock 170 is down and in the full back position when rotated, the stock may impeded access to the bolt release button. As described previously, stability detent 176 is provided on opposite side from hinge 160 and engages notch/guide 174 in hinge block 172 when the folding portion is in the unfolded position. As also noted before, in the embodiment shown, hinged portion 134 is spring biased (e.g. spring 160S, see FIG. 9) to the open position and hence eliminating a latch to hold in the folding portion in the open position and providing a lighter and smaller assembly. The folding portion 134 is shaped so that the operating mode selector 126 is readily accessible by the operator when the folding portion 134 is in its folded position and telescoped in (i.e. min. length). The operator may thus easily operate the firearm with the stock in any position. As may be realized, any "black rifle" may be configured in accordance with the exemplary embodiments as described above by replacing the conventional bolt carrier, action system and stock with the bolt carrier, action system 30 and stock 18, 118 of the exemplary embodiment.

Figure 15:
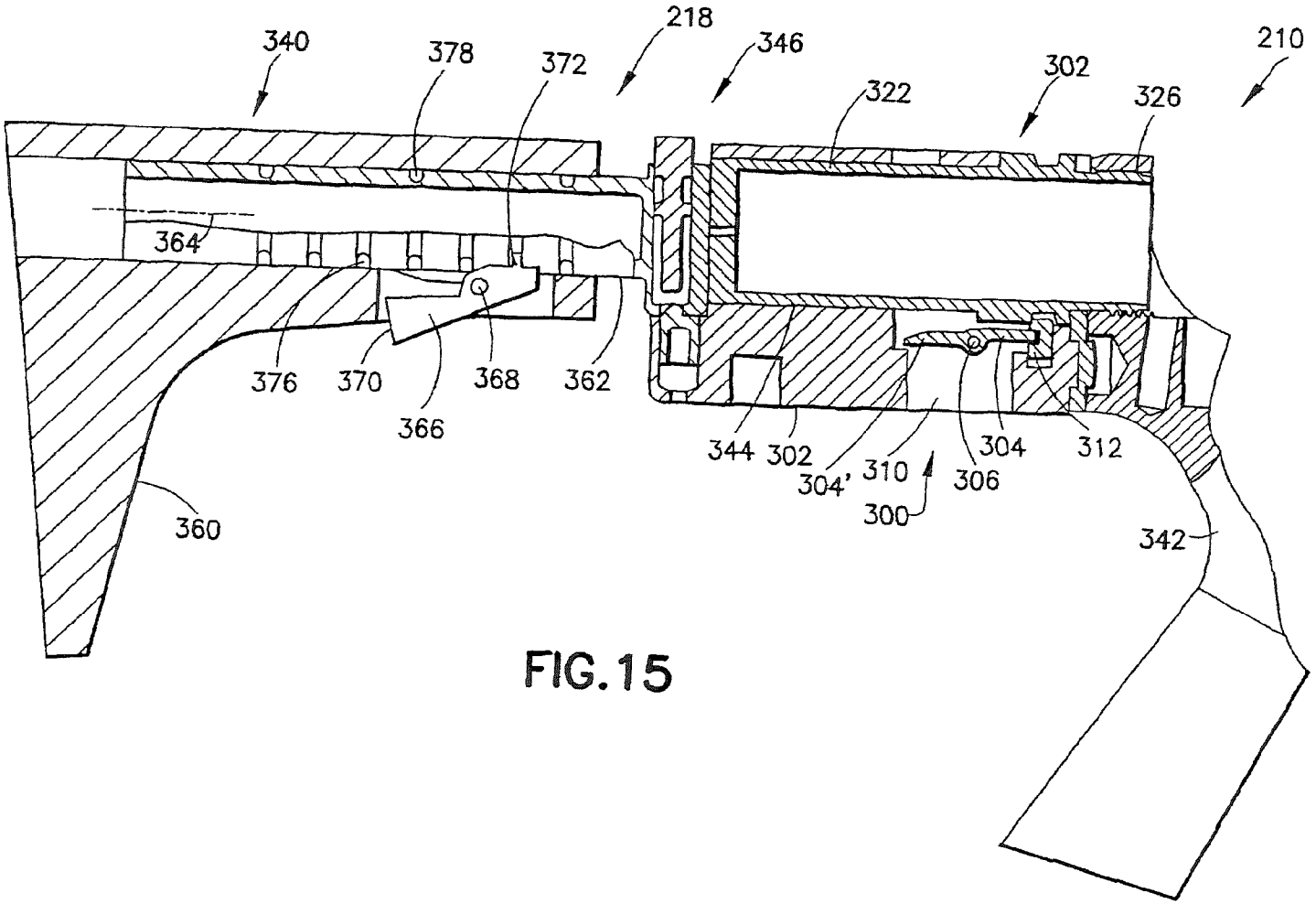
FIG. 15 is another section view of a folding stock of the firearm in accordance with another exemplary embodiment.
Figure 16:
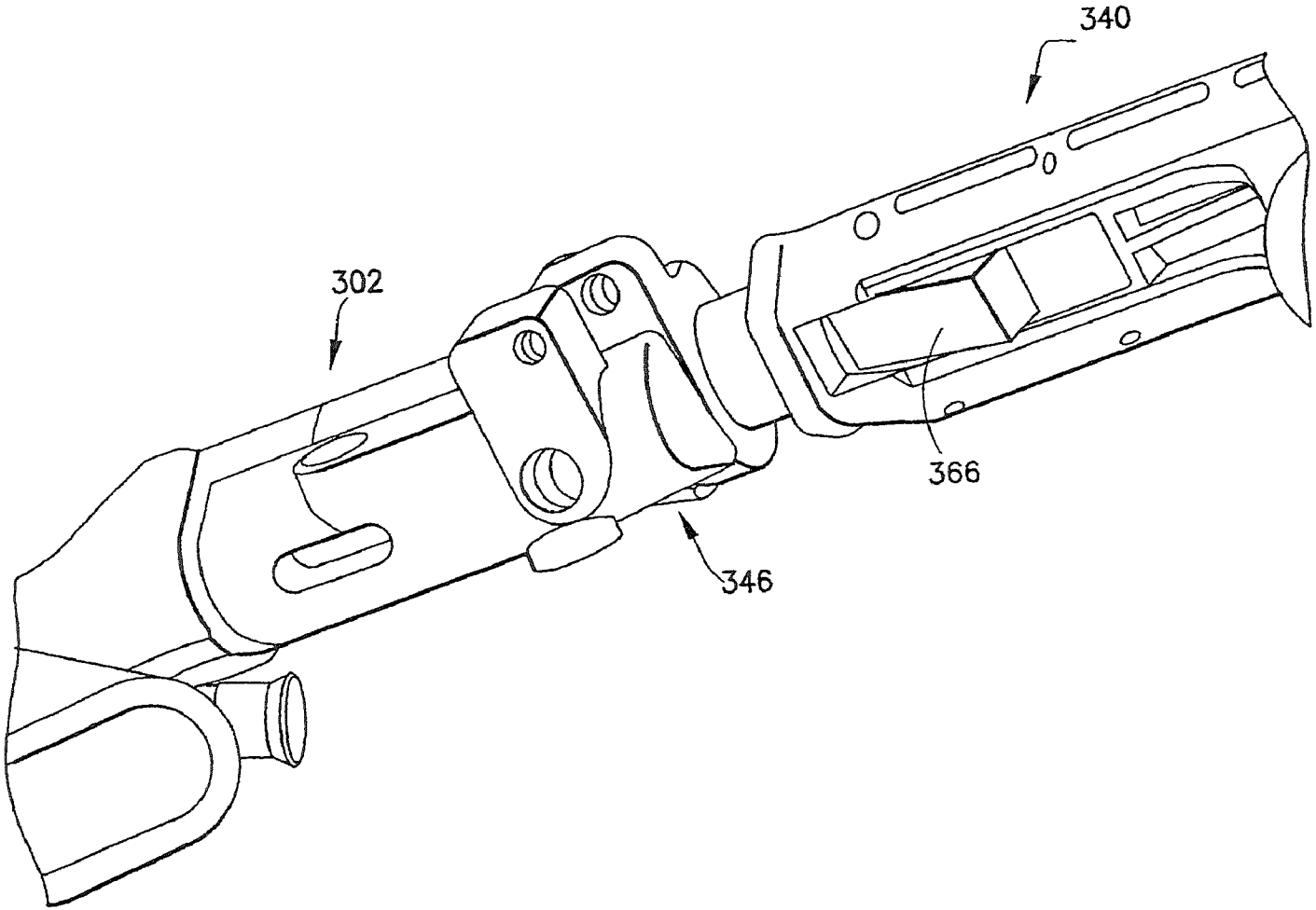
FIG. 16 is an isometric view of a folding stock.
Figure 17:
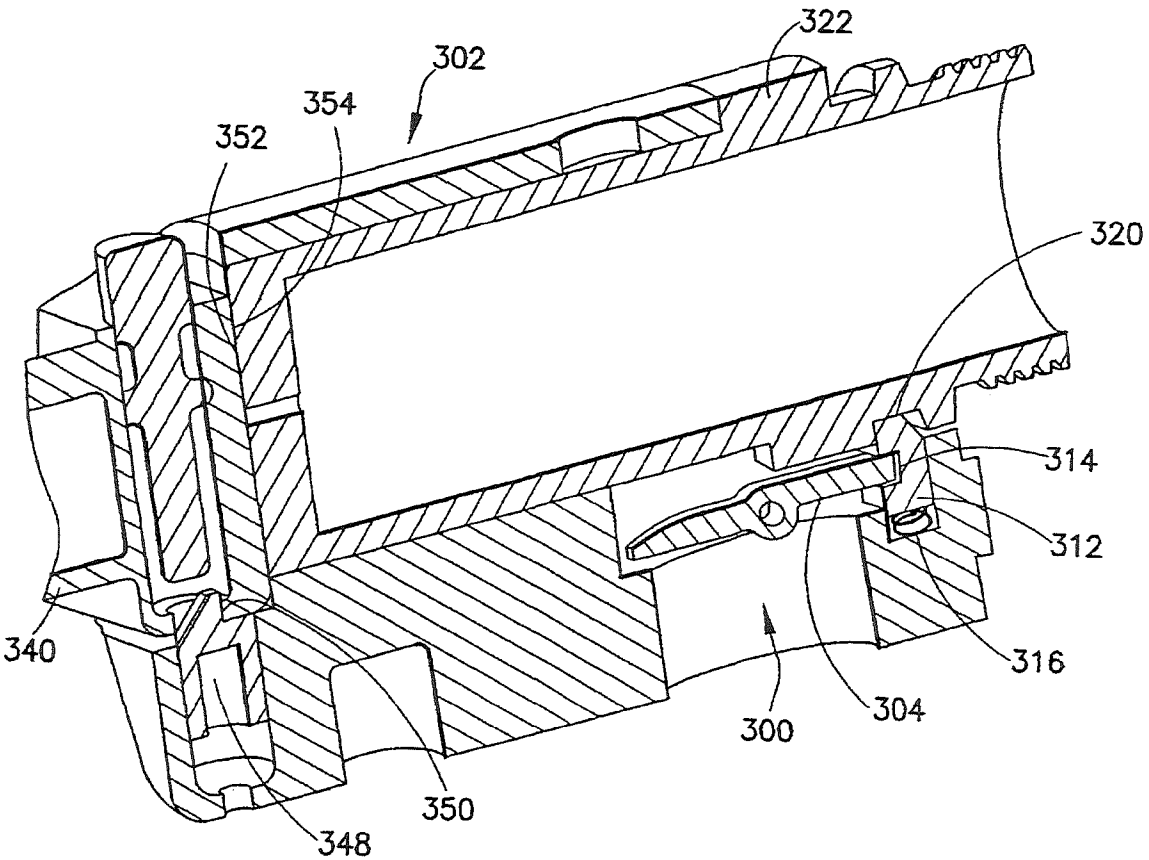
FIG. 17 is a section view of a folding stock.
Figure 19:
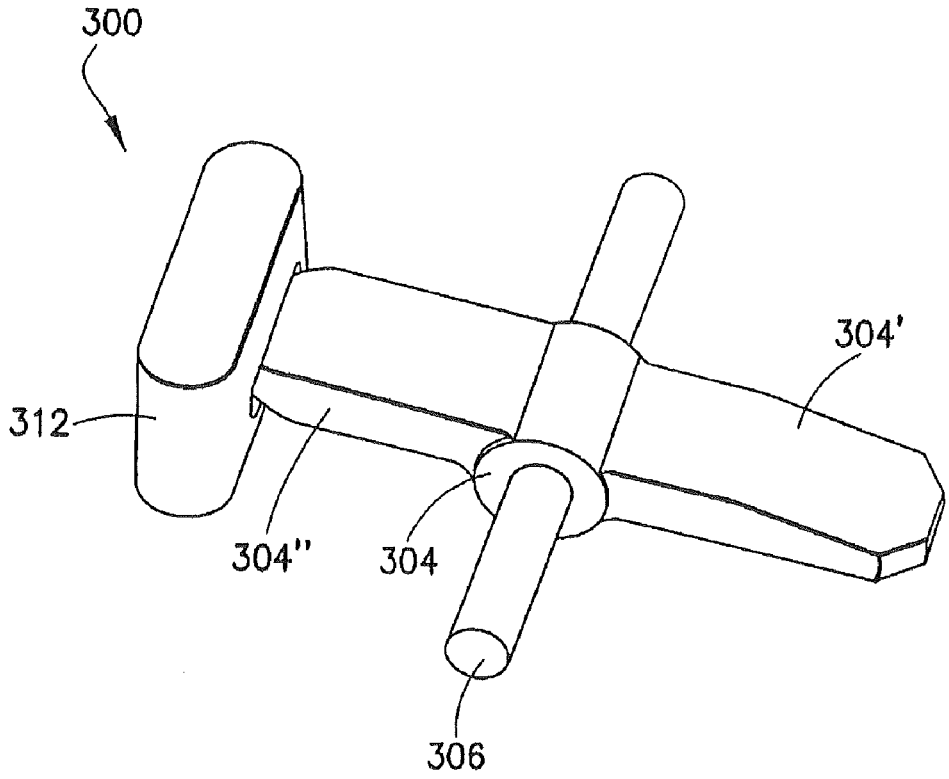
FIG. 19 is an isometric view of a latch.
Figure 20:
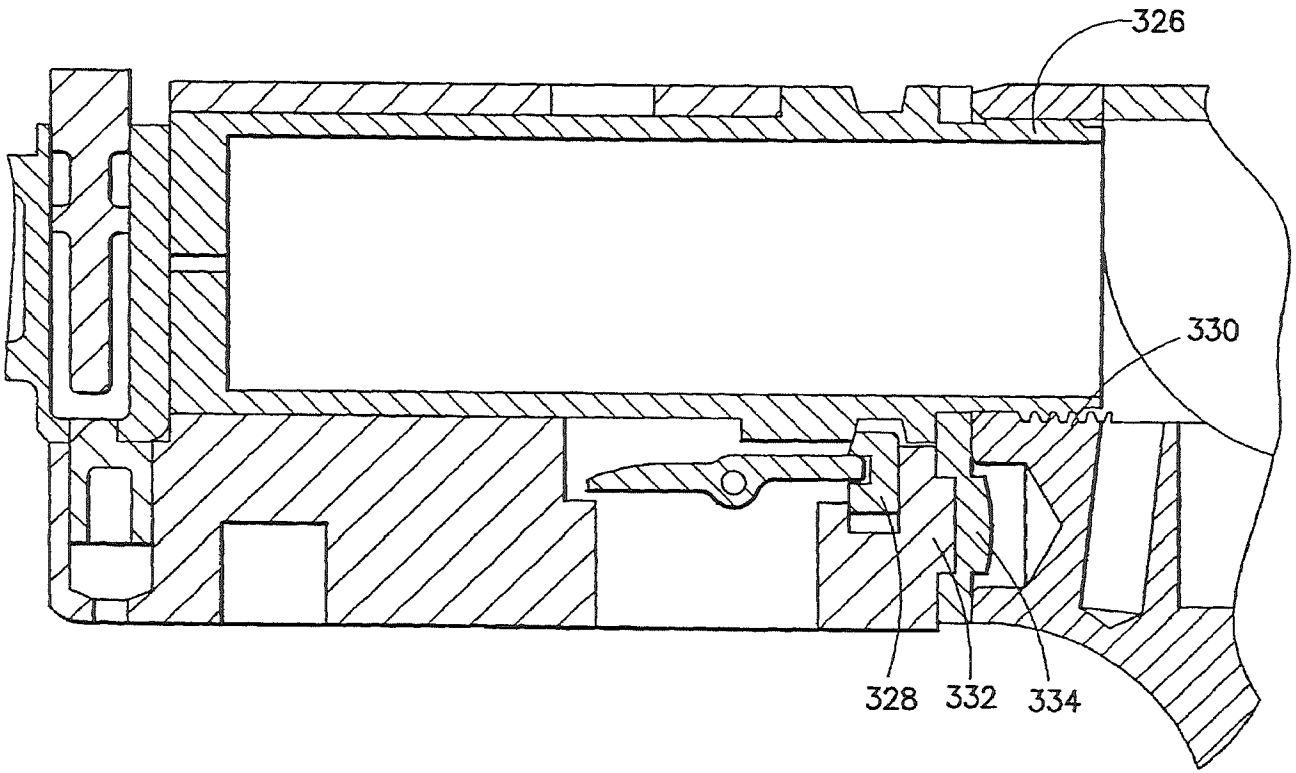
FIG. 20 is another section view of a folding stock.

Referring now to FIG. 15, there is shown a section view of folding stock 218 in accordance with another exemplary embodiment. In the embodiment shown in FIGS. 15-20 folding stock 218, of a firearm 20, is disclosed having quick detach mechanism 300 for folding buttstock 218. The quick detach mechanism disclosed may be used with a folding buttstock or alternately with a non folding (fixed) buttstock. In the embodiment shown, the folding buttstock 218 is substantially similar to folding stock 18, 118 described previously but also has latch 300 included as shown. Extension tube 322 is substantially similar to extension tube 42 described before, except as otherwise noted. Referring also to FIG. 19, there is shown an isometric view of latch 300. Latch 300 has latch lever 304 that pivots about pin 306 in housing 302. Latch 300 is encased inside of sleeve structure 302 to prevent inadvertent operator latch lever engagement, for example, during firing or handling of the firearm 40. In the exemplary embodiment, the latch lever is offset from the exterior of the sleeve and may be accessed through passage or recess 310 in the sleeve. To access the lever, an operator may use for example, a round or other elongated member in recess 310 of housing 302 to depress rear portion 304' of latch lever 304 to disengage tab 312 from receiver extension 322 allowing removal of buttstock 218. Referring also to FIGS. 17 and 20, there are shown section views of folding stock 218. Here, latch lever 304 has portion 304" that engages recess 314 in latch tab 312. Spring 316 keeps latch tab 312 engaged with groove 320 of extension tube 322. Tab 312 and groove 320 have mating slanted surfaces providing for a preloaded engagement of housing 302 against extension tube 322 where extension tube 322 is modified to provide an engagement groove 320 for the latch tab 312. The groove 320 and latch tab 312 have complementing camming surfaces that bias the sleeve 302 into the locked position against extension tube 322. Although latch 300 is shown as a tab and groove combination, any suitable latch mechanism may be provided. As may be realized, the quick detach allows the firearm to be used for example in a crew position, such as when vehicle borne and in the confines of the vehicle cabin by quickly detaching the stock 218, and then configured as a personal firearm, for example when the person dismounts by quickly attaching (e.g. snapping on) the stock 218. In the exemplary embodiment, the quick release 300 of the stock 218 may define is still another selector for selecting firearm configuration on the stock.

Figure 18:
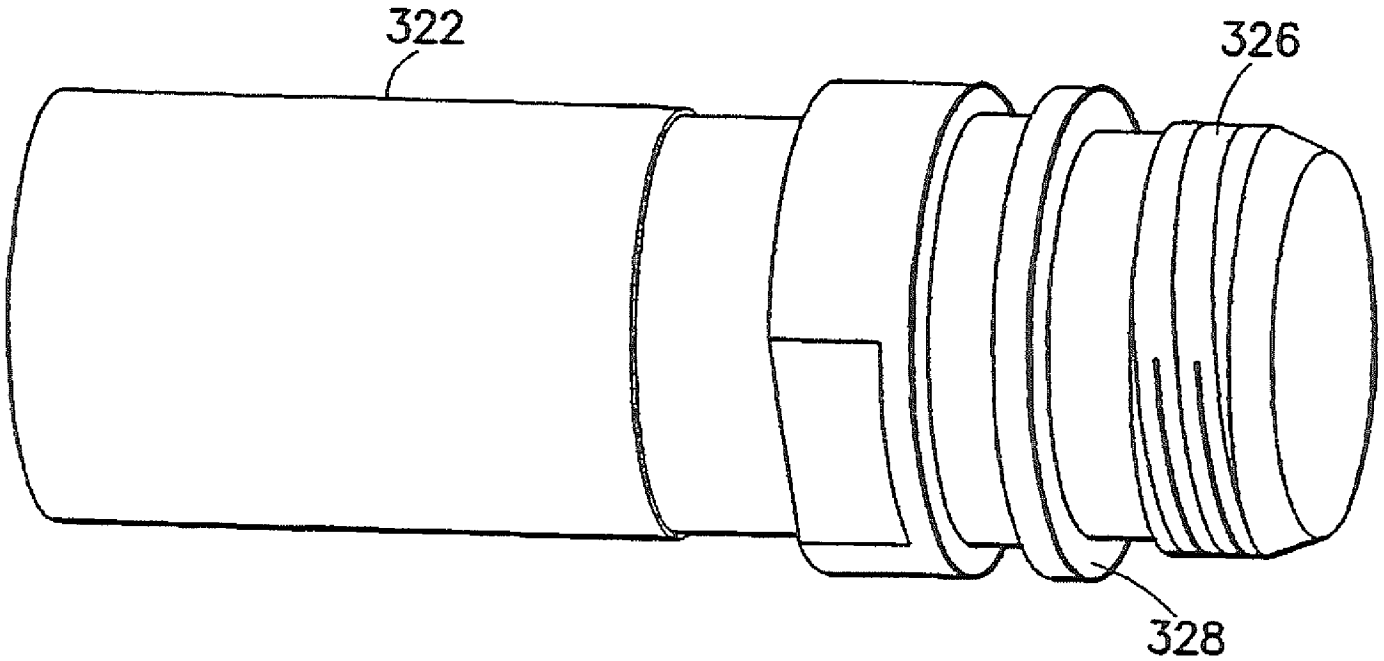
FIG. 18 is a isometric view of an extension member.

Referring also to FIG. 18, there is shown an isometric view of extension member 322. In the embodiment shown, extension tube 322 has threads 326 and face 328 that mate with receiver threaded rear bore 330 such that extension tube 322 directly engages the rear of the receiver (without a nut inside the receiver as in conventional arrangements). As seen in FIG. 20, in the exemplary embodiment, mating pin 332 on sleeve 302 also engages hole 334 in the receiver to prevent rotation of sleeve structure 302. In alternate embodiments, the extension member may be mounted to the receiver in any other desired manner. As noted before, the stock 218 in the exemplary embodiment shown in FIGS. 15-20, is illustrated as a folding stock with quick release 300 and also with a telescoping or extendable portion providing stock with selectably variable length similar to stock 18, 118 described before and shown in FIGS. 1-14. Similar features may be similarly numbered and Stock 218 may have what may be generally referred to as a base portion 302 and folding portion 340. As previously described, the base portion 302 of the stock 218, mates the stock to the lower receiver 342. The folding portion 340 may be joined to the base portion 302 by a coupling 346 that allows the folding portion 340 to be folded, or rotated relative to the base portion 302 from a deployed position or unfolded position to a folded or stowed position(s). The action system, similar to action system 30 may be housed, at least in part, within the base portion 302 of the stock 218 as has been previously described. As seen in FIG. 15, base 302 generally has a bore 344 formed therein allowing the base to be mounted to the receiver extension member or tube 322. The base 302 in the exemplary embodiment shown in the figures has a representative configuration and in alternate embodiments, the base may have any other desired arrangement. The base 302 may be made from any suitable material such as aluminum and may be of unitary construction. In alternate embodiments, the base may be formed as a multi piece member (i.e. instead of unitary construction, made of multiple components). In alternate embodiments, the base and lower receiver or extension tube may have interlocking detents with more than one selectable position allowing for example telescoping or rotational position between the receiver and base for a stock base of selectable variable length or rotational position. As noted before the shape of the stock base housing 302 in the illustrated embodiments is merely exemplary, and in alternate embodiments the stock base housing may have any other suitable shape. Referring also to FIG. 16, there is shown an isometric view of folding stock 218 in accordance with the exemplary embodiment. Coupling 346, may be similar to coupling 136 described before, and connects the end or folding portion 340 of the stock 218 to the base portion 302 and particularly in the exemplary embodiment, to the stock base 302. In alternate embodiments, the coupling may have any desired configuration. The coupling may also include a quick release allowing rapid removal and reinstallation of the folding stock portion 340 from the stock base 302. The configuration of the coupling 346 in the illustrated embodiments is merely exemplary, and in alternate embodiments the coupling may have any other suitable configuration. As seen in FIG. 17, interfacing seating surfaces 352, 354 on the folding portion 340 in the exemplary embodiment and stock base housing 302 may operate to fix the folding portion 340 to the base 302 when the folding portion is in its deployed position similar to coupling 36). When folding portion 340 is in the deployed position (shown in FIG. 15), in the exemplary embodiment, spring loaded detent 348 engages mating recess 350 automatically to lock the folding portion in its deployed (unfolded) position. As noted before, in the exemplary embodiment the folding portion 340 may incorporate a telescoping system allowing the folding portion to have a selectably variable length. The length of the folding portion may be adjusted/selected as desired with the folding portion in either the folded or deployed positions. In the exemplary embodiment folding portion 340 may have a rotatable butt stock 360 capable of being rotated about extension tube 362 about axis 364. The butt stock may include a release 366 that may be spring loaded to a locked position. The release 366 locks the position of butt stock 360 to extension tube 362. In the example shown, release 366 pivots about pin 368 and may be depressed on its rear portion 370 to overcome the spring load. Upon pressing rear portion 370, engagement portion 372 is raised, disengaging mating features on extension tube 362 and allowing butt stock 360 to be moved relative to extension tube 362. Butt stock 360 may be slid along extension tube 362 from a full back position to a full forward position and may be rotated about axis 364, about 180 degrees between up and down positions similar to butt stock 170 described previously. Extension tube 362 has both longitudinal top and bottom guide grooves and engagement slots allowing longitudinal and rotational positioning of butt stock 360 relative to extension tube 362. Here, the grooves in extension tube 362 may be located about 180 degrees apart, allowing 180 degree rotation of stock 360 about tube 362 where a mating feature on engagement portion 372 of spring loaded detent 366 engages the grooves 376, 378 in the extension tube 362. In alternate embodiments, more than two rotational positions or different rotational angles could be provided. In alternate embodiments, a detent may be provided in tube 362 and vice versa. Slots are provided on extension tube 362 intersecting grooves such as at about 90 degrees and allow butt stock assembly 360 to be incrementally located on extension tube 362 or pulled off extension tube 362. Features are provided in latch or release 366 that engage slots 376, 378 allowing the butt stock to be locked in a selected position. The butt stock may be located in either the up or down positions when the folding portion is in the unfolded position or in the folded position with the ability to rotate and lock in the up position butt stock 218 may be rotated up and flipped open, such as for a left hand user allowing easy access to trigger, fire selector or bolt carrier release and can also be provided for a right hand user. For example, when butt stock 360 is rotated up, there is suitable access to the bolt release button and unobstructed access to the trigger from either left or right side.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the exemplary embodiments.

What is claimed is:

1. An automatic or semiautomatic rifle comprising:

a receiver;

a bolt carrier movably coupled to the receiver;

an action system connected to the bolt carrier for cycling the bolt carrier in the receiver;

a receiver extension connected to the receiver, at least part of the action system extending into the receiver extension; and a folding stock connected to the receiver, the folding stock having a quick release latch engaged with the receiver, wherein the receiver extension is located within the folding stock, and wherein upon disengagement of the quick release latch, the folding stock is removable from the receiver.

2. The automatic or semiautomatic rifle of claim 1, wherein the quick release latch is encased inside the folding stock.

3. The automatic or semiautomatic rifle of claim 1, wherein the quick release latch comprises a spring loaded detent engaging the receiver extension.

4. The automatic or semiautomatic rifle of claim 1, wherein the quick release latch comprises a latch lever pivotally coupled to the folding stock, the latch lever coupled to a spring loaded detent.

5. The automatic or semiautomatic rifle of claim 1, wherein the quick release latch is recessed within the folding stock.

6. An automatic or semiautomatic rifle, comprising:

a receiver;

a bolt carrier movably coupled to the receiver;

an action system connected to the bolt carrier for cycling the bolt carrier in the receiver;

a receiver extension connected to the receiver, at least part of the action system extending into the receiver extension; and a folding stock connected to the receiver, the folding stock having a butt stock portion and an extension portion, the butt stock portion rotatable about the extension portion, the folding stock having a quick release latch engaged with the receiver, wherein the receiver extension is located within the folding stock, and wherein upon disengagement of the quick release latch, the folding stock is removable from the receiver.

7. The automatic or semiautomatic rifle of claim 6, wherein the folding stock is held in a deployed position by a spring loaded detent.

8. The automatic or semiautomatic rifle of claim 6, wherein the butt stock portion and the extension portion allows the folding stock to have a selectably variable length.

9. The automatic or semiautomatic rifle of claim 6, wherein the butt stock portion is axially movable along the extension portion.

10. The automatic or semiautomatic rifle of claim 6, wherein the quick release latch is encased inside the folding stock.

11. An automatic or semiautomatic rifle, comprising:

a receiver;

a bolt carrier movably coupled to the receiver;

an action system connected to the bolt carrier for cycling the bolt carrier in the receiver;

a receiver extension connected to the receiver, at least part of the action system extending into the receiver extension; and a stock connected to the receiver, the stock having a butt stock portion and an extension portion, the butt stock portion rotatable about the extension portion, the stock having a quick release latch engaged with the receiver, wherein the receiver extension is located within the stock, and wherein upon disengagement of the quick release latch, the stock is removable from the receiver.

12. The automatic or semiautomatic rifle of claim 11, wherein the butt stock portion and the extension portion allows the stock to have a selectably variable length.

13. The automatic or semiautomatic rifle of claim 11, wherein the butt stock portion is axially movable along the extension portion.

14. The automatic or semiautomatic rifle of claim 11, wherein the quick release latch is encased inside the stock.

15. The automatic or semiautomatic rifle of claim 11, wherein the quick release latch comprises a spring loaded detent engaging the receiver extension.

16. The automatic or semiautomatic rifle of claim 11, wherein the quick release latch is recessed within the stock.

* * * * *